United States Patent [19]

Schuller et al.

[11] Patent Number: 4,512,454

[45] Date of Patent: Apr. 23, 1985

[54] COIN APPARATUS HAVING COIN ESCROW AND RETURN MEANS

[75] Inventors: James T. Schuller, St. Louis County; Barry L. Smith, Florissant; Paul K. Griner, Maryland Heights, all of Mo.

[73] Assignee: UMC Industries, Inc., Stamford, Conn.

[21] Appl. No.: 569,613

[22] Filed: Jan. 10, 1984

Related U.S. Application Data

[63] Continuation of Ser. No. 316,078, Oct. 29, 1981, abandoned.

[51] Int. Cl.[3] ..... G07F 5/16

[52] U.S. Cl. ..... 194/1 D; 194/1 F

[58] Field of Search ..... 194/DIG. 15, DIG. 28, 194/100 A, 10, DIG. 27, DIG. 29, DIG. 30, 1 F, 1 D; 133/3 D, 3 R

[56] References Cited

U.S. PATENT DOCUMENTS

| | | | |
|---|---|---|---|
| 2,665,791 | 1/1954 | Caruso | 194/DIG. 30 |
| 3,237,745 | 3/1966 | Gerhart et al. | 194/10 |
| 3,896,915 | 7/1975 | Hayashi et al. | 194/1 N |
| 4,106,610 | 9/1978 | Heiman | 194/97 R |
| 4,286,703 | 9/1981 | Schuller et al. | 194/100 A |

*Primary Examiner*—Stanley H. Tollberg

*Attorney, Agent, or Firm*—Senniger, Powers, Leavitt and Roedel

[57] ABSTRACT

Coin apparatus for use in a vendor for handling acceptable coins and unacceptable coins or slugs deposited in the vendor, having change tubes for coins of different denominations, and operable to reject unacceptable coins and slugs, to accept acceptable coins and to deliver them as needed to the change tubes and, when not needed in the change tubes, to escrow them, to deliver coins from escrow to the cash box of the vendor upon a vend and to the coin return system of the vendor on recall of a deposit by a customer, to deliver coins from the change tubes on a recall in the same number and denomination as those deposited by the customer in the vendor and delivered to the change tubes, and to make change from the change tubes as needed on a vend.

15 Claims, 29 Drawing Figures

COIN APPARATUS HAVING COIN ESCROW AND RETURN MEANS

This is a continuation, of application Ser. No. 316,078, filed Oct. 29, 1981 abandoned.

BACKGROUND OF THE INVENTION

This invention relates to coin apparatus, and more particularly to such apparatus for use in a vendor, having an acceptance function for acceptable coins, a rejection function for unacceptable items (slugs or unacceptable coins) and a change-making function, including a self-replenishing change tube feature.

Reference may be made to U.S. Pat. No. 4,106,610 issued Aug. 15, 1978, and U.S. Pat. No. 4,286,703 issued Sept. 1, 1981 showing coin apparatus in the same general field as this invention.

SUMMARY OF THE INVENTION

Among the several objects of the invention may be noted the provision of improved coin apparatus of the class described having an escrow capability, i.e., the capability of holding coins deposited by a customer and enabling the customer to recall the deposit, the provision of such apparatus having change tubes for holding stacks of coins of different denominations for making change (e.g., U.S. nickels, dimes and quarters), adapted to deliver a coin of any one of said denominations inserted in the coin slot of the vendor to the respective change tube when the tube needs coins, adapted to divert coins from the tube to an escrow system when the tube does not need coins, and to reject unacceptable items (e.g., slugs and foreign or other unacceptable coins) inserted in the coin slot of the vendor; and the provision of such apparatus in which, on a recall, coins are returned to the customer from the change tubes and/or the escrow system.

In general, coin apparatus of this invention comprises a plurality of change tubes, one for each of a plurality of denominations of coins that may be deposited in the vendor in which the coin apparatus is used, each of the tubes being adapted to hold a supply of coins of a respective denomination, and adapted to have coins drop into it for stocking it with coins. Each of the change tubes has associated with it means for sensing the stocking of the tube with coins up to a predetermined amount (e.g., means for sensing the filling of the tube to a predetermined level). Coin sorting means is provided for sorting coins of the various denominations and delivering to each change tube coins of the denomination for that tube. Means is provided for holding coins in escrow for delivery either to a cash box or to a return system of the vendor. Control means controlled by said sensing means effects delivery of coins of each of said denominations deposited in the vendor to the coin sorting means as long as the change tube for coins of that denomination needs coins to bring the supply therein up to the respective predetermined amount, and effects delivery of coins of each of said denominations to said escrow means when the respective change tube does not need coins. Means is provided for actuating the escrow means to deliver any coins therein to the cash box upon operation of the vendor by a customer for a vend, and for actuating the escrow means to deliver any coins therein to the return system of the vendor upon operation by a customer of a coin return means (e.g. coin return button) of the vendor.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
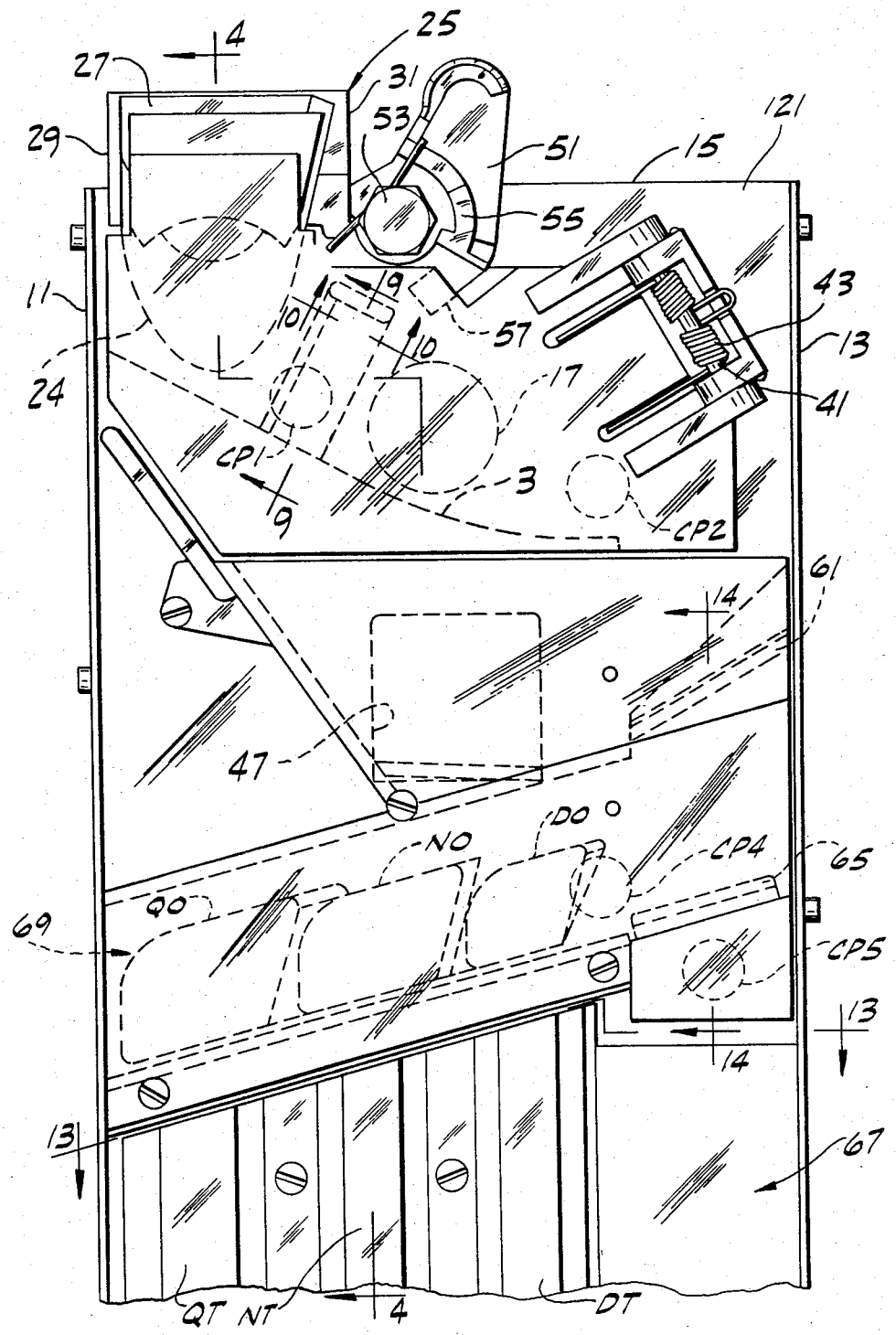
FIG. 1 is a view in front elevation of the upper part of coin apparatus of this invention.

Referring to the drawings, first more particularly to FIGS. 1-4, coin apparatus incorporating the present invention is indicated in its entirety by the reference numeral 1. Acceptable coins C (and unacceptable items such as slugs and unacceptable coins) entering the mechanism roll on edge down a track formed by a rail member 3 inclined down from the left side of the apparatus toward the right side of the apparatus as viewed from the front. Front and rear walls or panels 5 and 7, preferably molded of plastic, at opposite sides of the rail member 3 form in conjunction with the rail member an inclined chute 9 in which coins and other circular items are confined for rolling down from left to right. The panels are generally parallel and spaced apart a distance not substantially greater than the thickness of the thickest coin to be handled. The rear panel 7 is fixed in position extending between left and right side walls 11 and 13 of a housing 15 and is inclined off vertical as appears in FIG. 4 in the direction toward the front of the apparatus from top to bottom, so that items roll down on the rail member 3 in face-to-face engagement with the rear panel 7.

Means indicated generally at 17 (see FIG. 2) is provided along the chute 9 for detecting whether an item traveling therein is an acceptable coin or an unacceptable item and, if it is an acceptable coin, detecting its denomination. The detecting means 17 is adapted on passage thereby of an item in chute 9 to transmit a signal indicative of the item being an unacceptable item or an acceptable coin, and if an acceptable coin, indicative of its denomination. The detecting means is mounted on the back face of the rear panel or wall 7 of chute 9 and an item rolling down the chute leans back on the panel 7 as it passes the detecting means so that each item rolls past it in the same plane for consistent detection.

Figure 9:
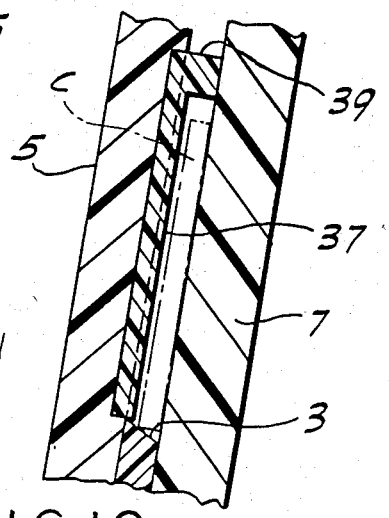
FIG. 9 is a section generally on line 9—9 of FIG. 1 showing a coin stabilizer.

Coins and other items are adapted to enter the chute 9 laterally through the rear panel 7 at a point upstream of the detecting means adjacent the left side of the apparatus (as viewed from the front) via an entrance comprising a passageway 21 having an inclined reach extending laterally (i.e., in front to rear direction with respect to the apparatus) upwardly away from the chute at an inclination off vertical more than the chute. For example, this reach of passageway 21 may be inclined 33° off the plane of the rear panel 7. The passageway 21 has an inlet 23 at the upper end of the inclined reach adapted for entry of coins into the passageway in a generally vertical plane laterally offset (rearwardly offset) from the chute, and an outlet 24 at the lower end of the inclined reach opening into the chute 9 through the rear panel 7 at an elevation above the rail member 3 therebelow and at a location upstream (to the left as viewed from the front of the apparatus) of detecting means 17. As will appear, a coin C entering through the inlet 23 is adapted to slide down the inclined reach of the passageway 21 and to be guided thereby laterally across the chute 9 for impact against the front panel 5. This serves to deaden the motion of the coin and to deflect it down onto the track 3 for smoothly rolling on edge down the track without substantial bounce or flutter and with the coin leaning against the rear panel 7 for accurate detection by the detecting means 17. To ensure that the coin rolls down the track generally in full face-to-face contact with the rear panel 7, the track is canted with respect to the walls 5, 7 of the chute 9 (see FIG. 9), being inclined downwardly from the front panel toward the rear panel at an angle off horizontal more than the angle at which the chute is inclined off vertical.

Figure 3:
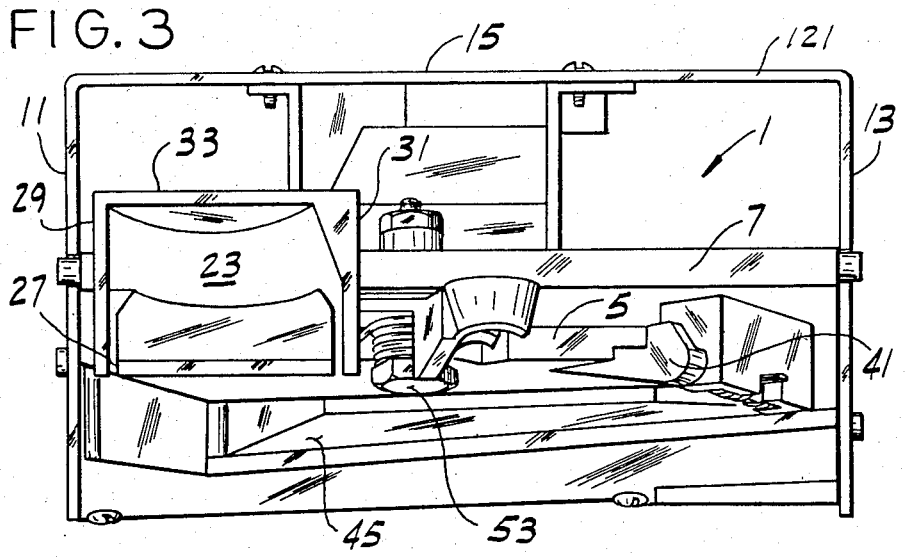
FIG. 3 is a top plan of FIG. 1.
Figure 5:
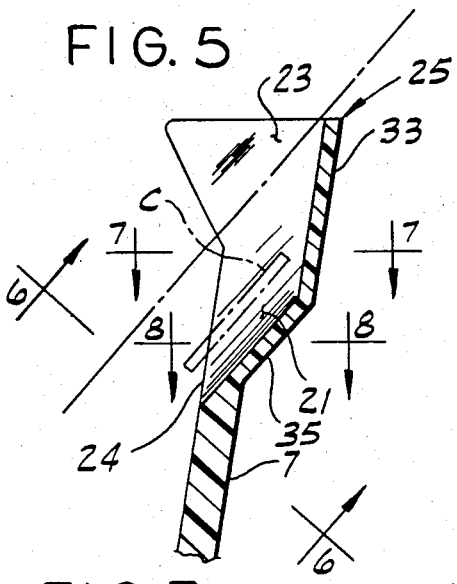
FIG. 5 is a portion of FIG. 4 showing a coin entrance.
Figure 6:
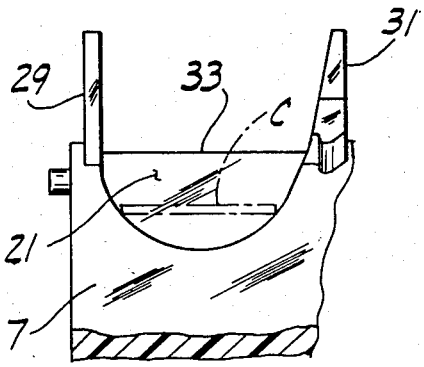
FIG. 6 is a section generally on line 6—6 of FIG. 5.
Figure 7:
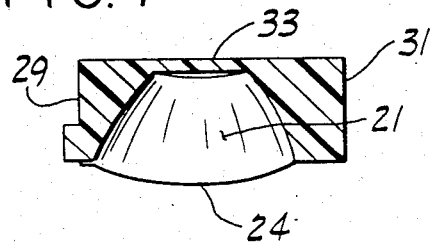
FIG. 7 is a horizontal section generally on line 7—7 of FIG. 5.
Figure 8:
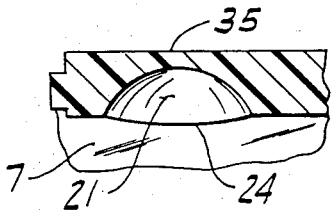
FIG. 8 is a horizontal section generally on line 8—8 of FIG. 5.
Figure 4:
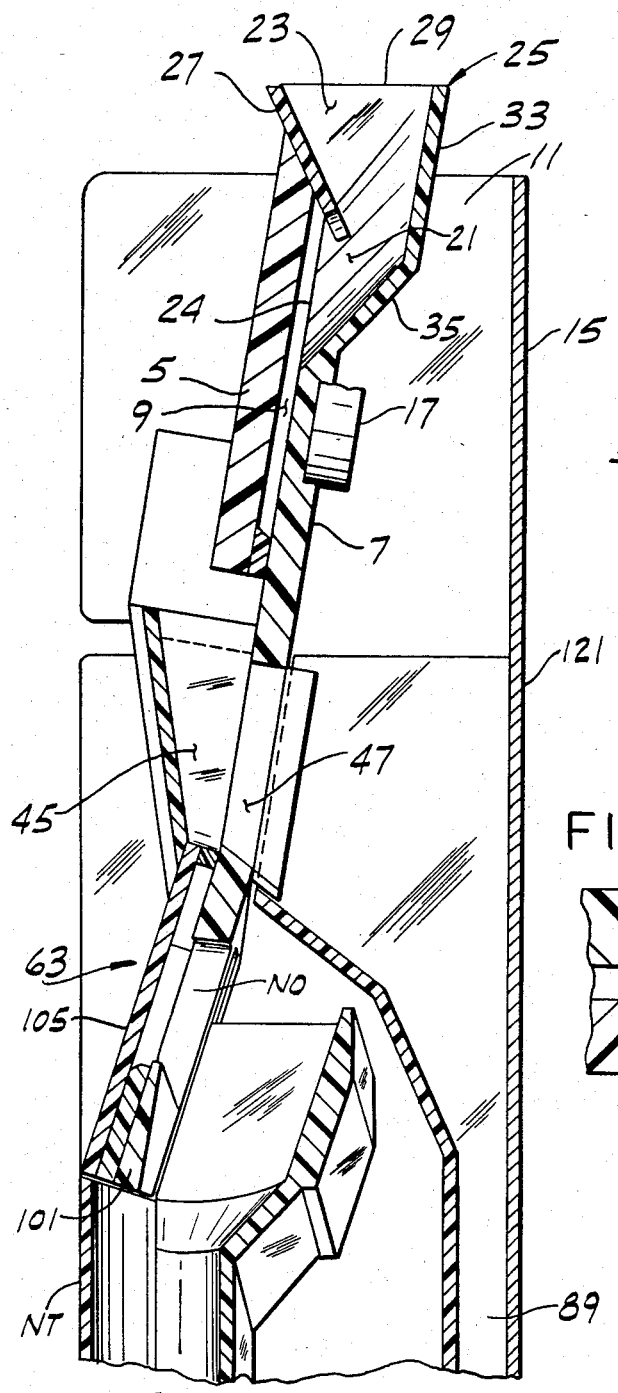
FIG. 4 is a vertical section generally on line 4—4 of FIG. 1.

A channel-shaped entrance or inlet formation, generally designated 25, at the top left of the rear panel 7 and a tongue 27 at the top left of the front panel define passageway 21. As shown in FIGS. 3 and 4, the inlet formation is integrally formed (e.g., molded) with the rear panel 7 and has left and right side walls 29, 31, a rear wall 33 spaced rearwardly of and generally parallel to the plane of panel 7, sloping slightly forwardly from top to bottom with respect to the apparatus, and a bottom wall 35 which is inclined downwardly from the rear wall 33 to panel 7 at an angle corresponding to that of the inclined reach of passageway 21. The inside surfaces of the side and bottom walls of the inlet formation define the inclined reach of passageway 21.

The tongue 27, which is also preferably of molded plastic, is secured (e.g., bonded) on the front panel 5 and forms in conjunction with the rear and side walls 29, 31 and 33 of the entrance formation 25, the inlet 23 of passageway 21. The tongue is inclined toward the rear of the apparatus from top to bottom to funnel coins down for entry into the inclined reach of passageway 21, the coins assuming a generally vertical orientation as they drop through the throat of the inlet between the bottom edge of the tongue 27 and the rear wall 33 of the inlet formation 25. On striking the bottom wall 35 of formation 25, the coins pivot clockwise (as viewed in FIG. 4) from a generally vertical plane into the inclined plane of the passageway. The bottom edge of the tongue 27 is upwardly arched to prevent jamming of the coins as they drop through the throat of the inlet 23 (see FIG. 1).

As shown in FIGS. 2 and 6–8, the inclined reach of passageway 21 is concave and is so sized and contoured that a coin is adapted to slide down the passageway toward the chute in an inclined plane with only the opposite edge portions of the coin in contact with surfaces of the passageway. As viewed from the front of the apparatus (FIG. 2), the passageway appears generally parabolic in shape. As viewed in transverse section (FIG. 6) it is rounded, having a radius of curvature preferably greater than that of the largest diameter coin the apparatus is designed to handle. For example, assuming the apparatus is capable of handling nickels, dimes, quarters and the new U.S. dollar, which has a diameter slightly greater than that of the quarter, the radius of curvature may be about 0.69 inches. A rounded configuration is desirable in that it provides for a smooth and consistent delivery of coins to the chute 9, this being due to the fact that opposite edge portions of the coins sliding down the inclined reach of passageway 21 are always in contact with surfaces of the passageway regardless of the size of the coin. Thus, acceptable coins and unacceptable items of all sizes capable of being handled by the coin apparatus are accurately guided down and out of the passageway and into the chute 9 along a single predetermined path. The fact that the inclined reach of the passageway is of rounded configuration is also advantageous in that the force of coins dropping through the inlet 23 onto the bottom wall 35 of the entrance formation 25 is more evenly distributed for better surface wear. This is particularly important where the surface of the passageway 21 is of plastic.

The outlet or mouth 24 of passageway 21 is dimensioned to be of sufficient height for permitting a coin sliding out of the passageway and impacting against the front panel 5 (i.e., the left wall of the chute 9 as viewed in FIG. 4) to clear the roof of the passageway as it pivots from the inclined plane of the passageway into the plane of the chute.

Travel of coins and other circular items through passageway 21 and their impact against the front panel 5 for deflection down onto the rail member 3, serves to deaden or retard the motion of the items so that they roll smoothly without substantial bounce or flutter and at substantially the same rate of speed down the chute while leaning back against the rear wall of the chute formed by panel 7. This enables the items to be accurately detected by detecting means 17.

Figure 10:
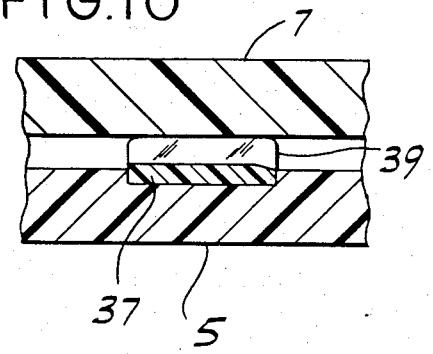
FIG. 10 is a section generally on line 10—10 of FIG. 1.

A plate 37 is set flatwise into the front panel 5 along the track at a location downstream of outlet 25 and immediately upstream of the detecting means. As shown best in FIG. 9, the rear (right) face of this plate 37 projects into the chute 9 and restricts the width thereof to a width only slightly greater than the thickness of the thickest coin to be handled by the apparatus. The upstream edge of the plate is beveled to guide items therepast (see FIG. 10). The plate has a portion or flange 39 along its upper edge projecting from the rear face of the plate toward the rear wall 7 of the chute and spaced above the rail member 3 a distance not substantially greater than the diameter of the largest diameter coin to be handled.

The rail member 3 forming the track down which coins roll past the detecting means 17 is secured to the front panel 5 which is pivoted as indicated at 41 at its upper right hand corner for swinging movement toward and away from the rear panel 7. A spring 43 biases the front panel toward its closed position wherein the rail member engages the rear panel. The panels lie generally parallel to one another spaced the width of the rail member. As previously stated, this spacing is not substantially greater than the thickness of the thickest coin to be handled. The front panel 5 is adapted to be swung away from the rear panel 7 to remove the rail member from below a coin or other item which may be jammed in the chute 9 to clear the jam (i.e., for scavenging), the coin or other item then sliding down the rear paneling to the open top of a return chute 45, the rear wall of which is formed by the rear panel 7. The bottom of this return chute is inclined for directing items falling to the chute through an opening 47 in the rear panel 7 and, from there, to a conventional return system (not shown) for delivery of the items to a return cup, for example.

A scavenging mechanism comprising a scavenging lever 51 pinned at 53 to the rear panel 7 adjacent the entrance formation 25 is provided for camming the front panel away from the rear panel for scavenging. The lever 51, preferably of plastic, has an inclined camming surface 55 which is interengageable with a wear pad 57 mounted on the rear face of the front panel 5 for swinging the latter away from the rear panel when the lever is pivoted clockwise from the position shown in FIG. 1. The lever is spring-biased toward its FIG. 1 position in which it is removed from between the panels.

After an item rolls off the right end **3*e* of the rail member 3 and out of the chute 9 (see FIG. 2), it falls for some distance at the right of the coin apparatus and its next course of travel depends on whether it is an acceptable coin (as herein disclosed a U.S. nickel, dime, quarter or new dollar coin), or an unacceptable item. If it is an unacceptable item (a slug or unacceptable coin), it strikes a gate 61 in its fall and is directed to the return chute 45 for passage through opening 47 to the above-mentioned return system. Gate 61 is normally closed. If the item is an acceptable coin, gate 61 opens, allowing the coin to drop farther to an accept system generally designated 63. The latter comprises a gate 65 which may be referred to as the coin sorting/escrow gate. The gate 61 may be referred to as the accept/return gate. Gate 65 is normally open. With gate 61 open, an accepted coin (nickel, dime, quarter, dollar) dropping past the opened gate 61 drops past the open gate 65 into means indicated generally at 67 for holding coins in escrow for delivery either to a cash box or to the return system of the vendor. With gate 65 closed, an accepted nickel, dime or quarter dropping past the opened gate 61 strikes gate 65 and is directed to a coin sorting means 69** which is adapted to sort coins of the nickel, dime and quarter denominations and deliver them to nickel, dime and quarter change tubes.

Thus, the coin apparatus comprises the first chute 9 inclined downwardly from one side of the apparatus (its left side as viewed in FIGS. 1 and 2) toward the other, down which acceptable coins and unacceptable items received from the coin slot of the vendor in which the apparatus is used may roll. Adjacent the lower (right) end of this chute 9, which may be referred to as the first chute, is the accept/return gate 61. Below the latter is the coin sorting/escrow gate 65. Chute 45, which may be referred to as the second chute, is located below the first chute 9, extending from gate 61 inclined downwardly toward the left side of the apparatus (i.e. inclined oppositely from chute 9) for delivery of unacceptable items to the return system of the vendor via the opening 47. Below the coin sorting/escrow gate 65 is the escrow means 67. The coin sorting means 69 comprises a third chute 71 below the second chute 45 extending from the coin sorting/escrow gate 65 inclined downwardly like the second chute 45 toward the left side of the apparatus, and having coin-diameter-related drop-out openings DO, NO and QO and along its length for drop-out of dimes, nickels and quarters. Below these drop-out openings are the respective dime, nickel and quarter change tubes DT, NT and QT, the arrangement being such that a dime dropping out through opening DO (which is slightly larger than a dime but smaller than a nickel) falls into the dime change tube DT, a nickel dropping out through opening NO (which is slightly larger than a nickel but smaller than a quarter) falls into the nickel change tube NT, and a quarter dropping out through opening QO (which is slightly larger than a quarter) falls into the quarter change tube QT. Though it is not shown in the drawings, it is contemplated that a dollar coin change tube may be used. This would be located at the left of the apparatus as viewed in FIGS. 1 and 2 in position for a dollar coin rolling down and out of chute 69 through a slot in wall 11 to drop into it.

Each change tube has associated with it means for sensing the stocking of the tube with coins of the respective denomination up to a predetermined amount, the sensing means for the nickel, dime and quarter change tubes being respectively designated NS, DS and QS. Each sensing means may be of the type shown in U.S. Pat. No. 4,286,703 issued Sept. 1, 1981, involving a sensor mount carrying a light emitting diode (LED) for emitting a beam of light across the tube and a phototransistor for receiving the beam, with the arrangement such that as long as the stack of coins in a tube is below the level of the sensing means for that tube, the beam of light from the LED to the phototransistor is uninterrupted. When the tube is filled to the level of the sensing means, the coin at the top of the stack blocks the beam and the sensing means transmits a signal indicative of the change tube being filled with coins to that level.

Figure 21A:
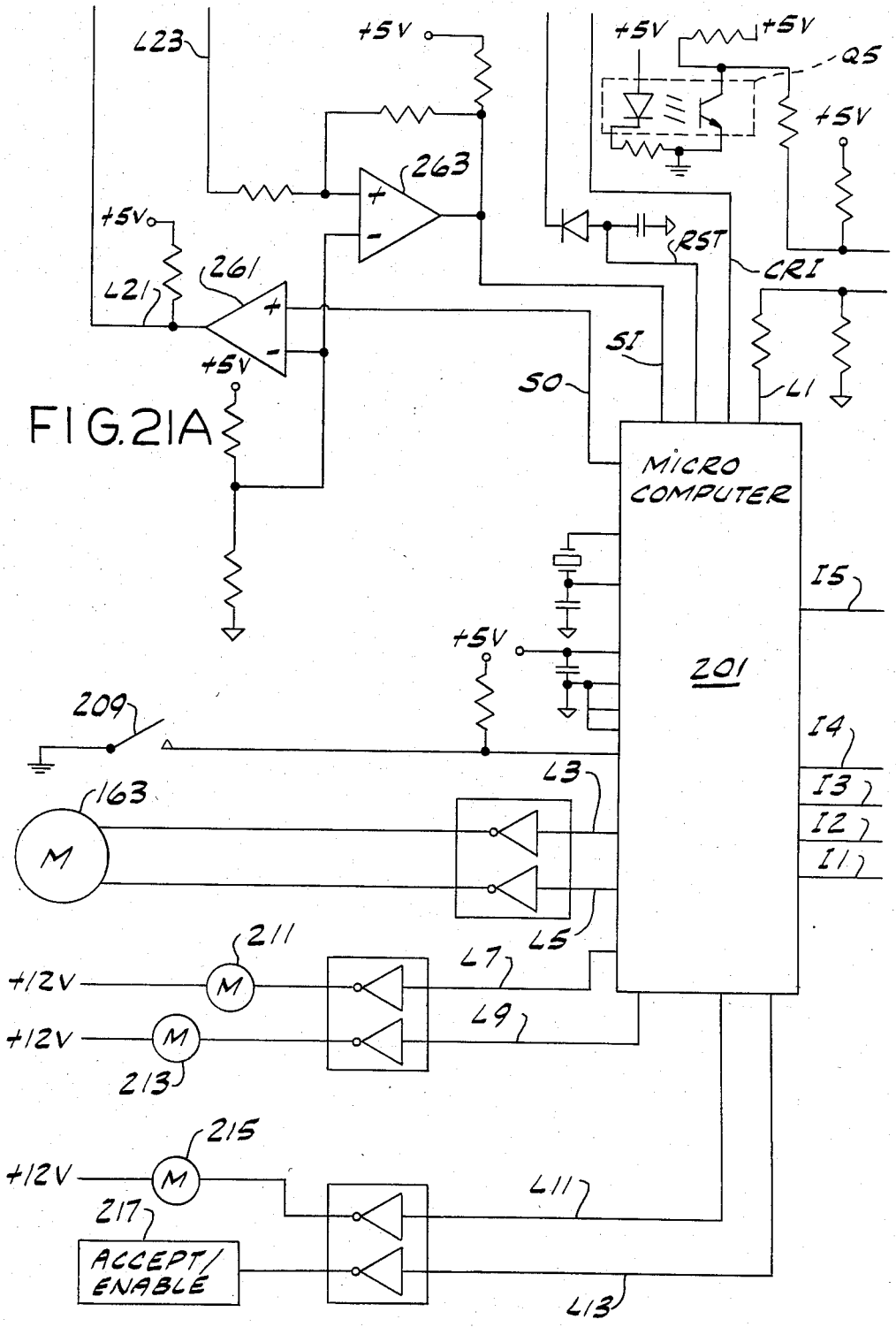
FIGS. 21A-21D are electrical schematic diagrams of the circuitry of the coin apparatus of this invention.

Each change tube also has associated with it at its lower end means indicated generally at 73 for ejecting the lowermost coin of the stack therein. This ejecting means is preferably similar to that shown in U.S. Pat. No. 4,257,436 issued Mar. 24, 1981 comprising a U-shaped ejector with a T-shaped projection, but which is motor-driven instead of solenoid-driven. Motors for driving the ejectors are indicated at 211 (nickel), 213 (dime) and 215 (quarter) in FIG. 21A.

Figure 14:
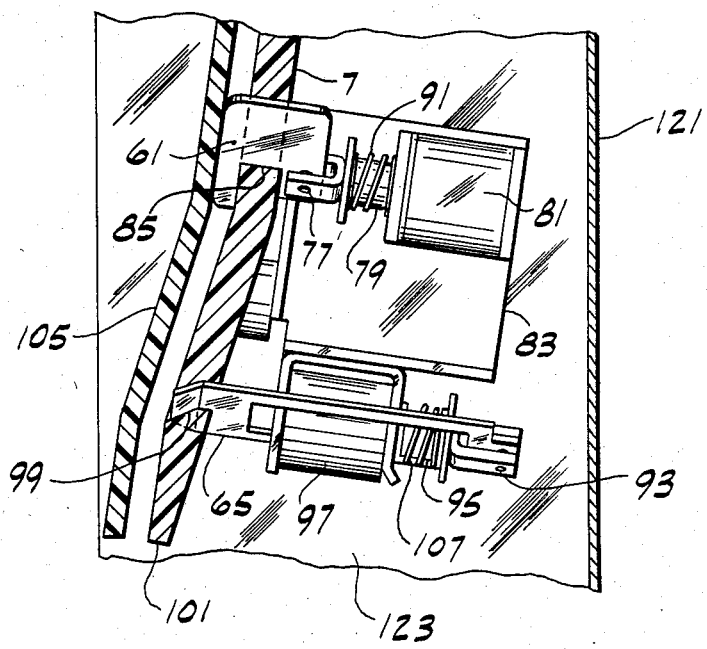
FIG. 14 is a view in section on line 14—14 of FIG. 1.

The accept/return gate 61 is located at the right of the apparatus in position above the entrance **69*a* of the coin sorting means 69 and below and to the right of the lower or downstream end 3*e* (the right end) of the rail member 3. It comprises a plate secured as indicated at 77 in FIG. 14 on the forward end of the plunger 79 of a solenoid 81 mounted on a bracket 83 on the rear panel 7 of the apparatus. The gate extends through a slot 85 in rear panel 7, the slot and gate being in a plane inclined downwardly from right to left as viewed in FIG. 2. The bottom of chute 45 is formed by a rail 87 on the front of rear panel 7 inclined downwardly from right to left from just below the left edge 61***e* of the gate (see FIG. 2), the arrangement being such that an item intercepted by the closed gate 61 rolls off the gate to the left and down the rail 87 until it reaches the opening 47, whereupon it falls out to the rear though opening 47 and into a chute 89 for delivery to the return system of the vendor. The gate 61 is biased to its closed position by a spring 91, and is opened by the solenoid 81 on energization of the solenoid.

The coin sorting/escrow gate 65 is located at the right of the apparatus in position below the accept-/return gate 61 and above the escrow means 67. It comprises a plate secured as indicated at 93 on the rearward end of the plunger 95 of a second solenoid 97 mounted on the bracket 83 at the rear of the apparatus. The gate 65 extends through a slot 99 in a lower section 101 of the rear panel 7 which is inclined off vertical somewhat more than the upper section of panel 7, as appears in FIG. 14, the slot 99 and gate 65 being in a plane inclined downwardly from right to left as viewed in FIG. 2. The bottom of the coin sorting means 69 is formed by a rail 103 on the front portion of panel 7 inclined downwardly from right to left from just below the left edge 65*e* of the gate 65 (see FIG. 2), the arrangement being such that a coin intercepted by the closed gate 65 rolls off the gate and down the rail 103 to the drop-out openings, which are in section 101 of the panel 7. A front for the coin sorting means is indicated at 105. The gate 65 is biased to its open position by a spring 107, and is closed by the solenoid 97 on operation of the solenoid.

The escrow system 67 comprises means constituted by what may be referred to as a hopper 109 for receiving coins which drop past the opened gate 65 having a closure 111 (which may be referred to as a release gate or trap door) for holding the coins in escrow either for passage either to the cash box of the vendor in which the coin handling apparatus is used or to the coin return system of the vendor for delivery to the coin cup of the vendor. The hopper is formed by a passage 113 in an escrow system body 115, which may be molded of suitable plastic, having an upper vertical section 113*a* open at the top for entrance of coins which drop past the opened gate 65 and a lower inclined section 113*b*. The release gate 111 is pivoted for swinging movement between a closed position closing the lower end of the inclined lower section 113*b* of passage 113 and an open position allowing coins to drop out of the hopper. Coins so released from the hopper drop into a passageway 117 below the gate 111. Means indicated at 119 is provided in this lower passageway in the escrow system body 115 movable between a first position (see FIGS. 15 and 18) for delivery of coins released from escrow to the cash box, and a second position (see FIG. 20) for delivery of coins released from escrow to the coin return system for return to the customer.

Figure 11:
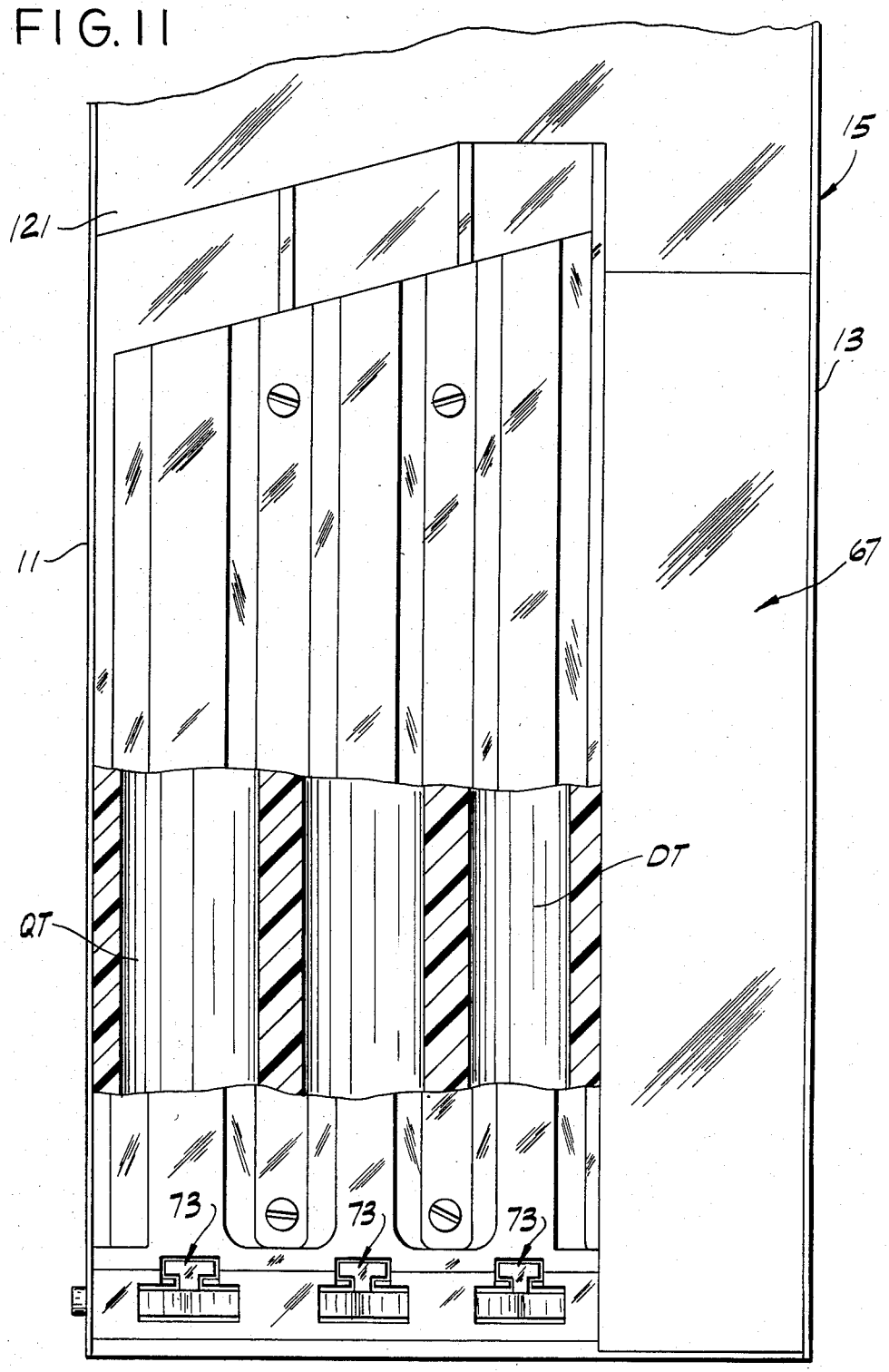
FIG. 11 is a view in front elevation of the lower part of coin apparatus of this invention, with parts broken away and shown in section.

The escrow system body 115 is located at the right of the bank of change tubes NT, DT, QT as viewed in FIGS. 1, 2 and 11, the passage 113 which forms the hopper 109 and the passageway below the hopper being on the right side of the body, i.e., on the side of the body away from the dime change tube DT. The bank of change tubes, the escrow system body and the parts thereabove forming the chutes 9 and 45 and the coin sorting means 69, are suitably mounted in the housing 15, which as illustrated may be a sheet metal structure comprising a back plate or panel 121 and left and right side flanges 11 and 13. The right side flange 13 of this housing forms a wall for the passage 113 and passageway 117 of the escrow system body 115.

Figure 12:
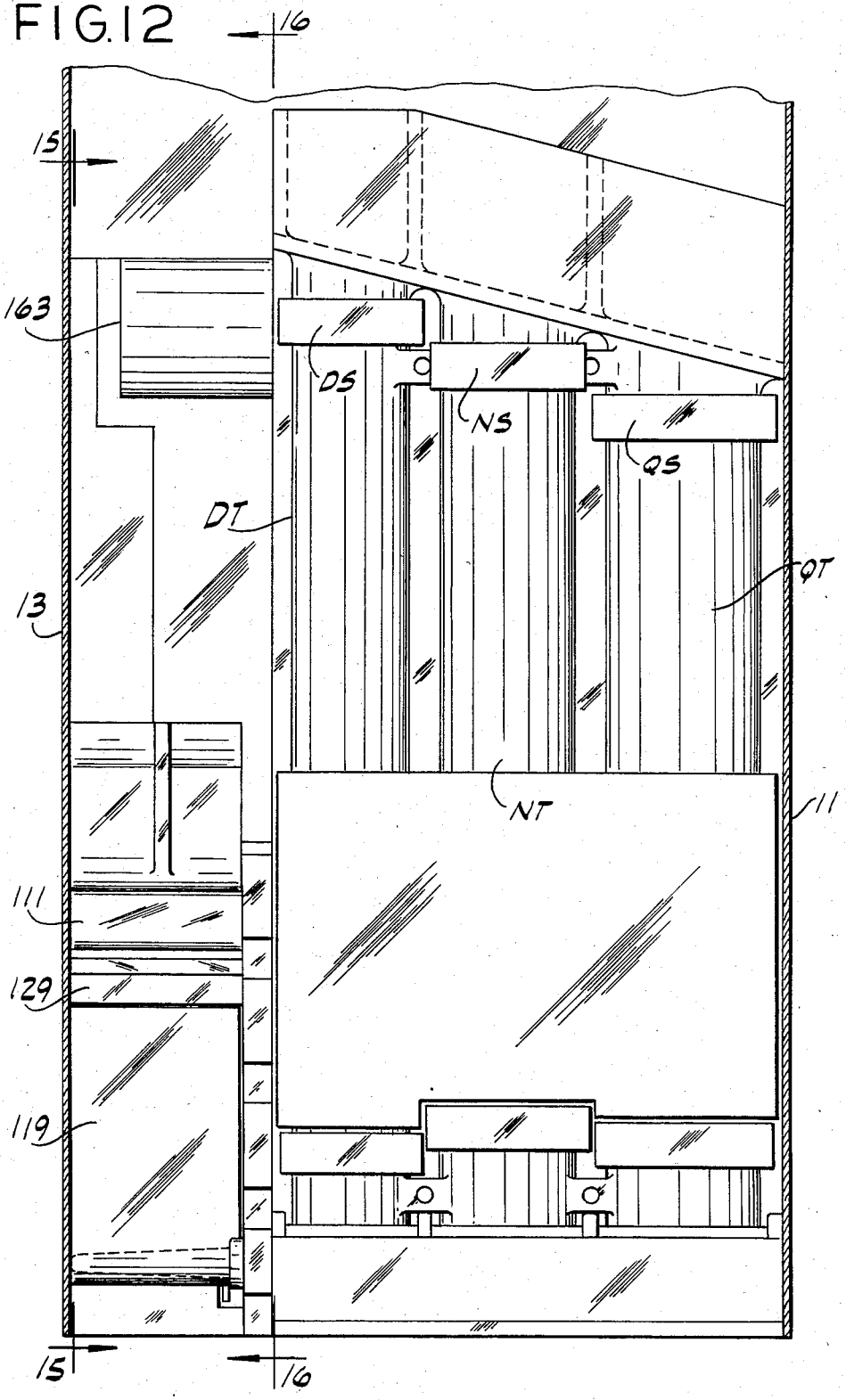
FIG. 12 is a view in section on line 12—12 of FIG. 13, showing the rear of the lower part of the coin apparatus with a back panel of a housing of the apparatus broken away.
Figure 13:
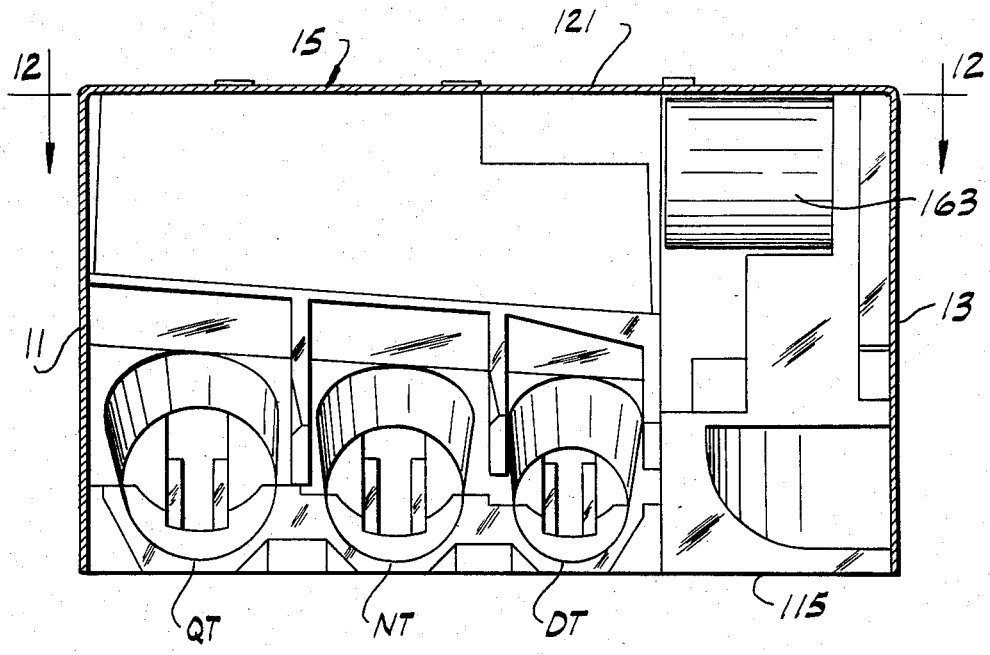
FIG. 13 is a plan of FIG. 11.
Figure 17:
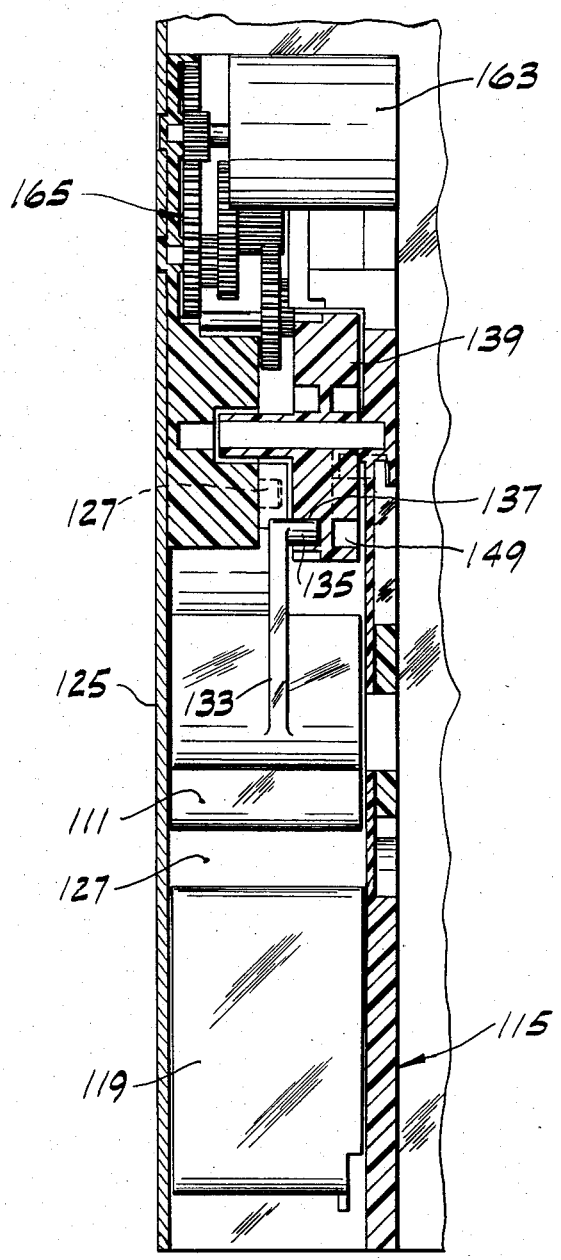
FIG. 17 is a section on line 17—17 of FIG. 16.

The release gate 111 is pivoted for its swinging movement between its closed and open positions by means of a pivot pin 127 mounted in the escrow system body 115 adjacent the top of the inclined lower section 113*b* of the passage 113. The body 115 has a generally triangular section 129 at its left as viewed in FIG. 15, which is notched at 131 to accommodate the lower end of the gate 111 in its closed position. The gate has a web 133 carrying a cam follower 135 riding in a cam track 137 in one face of a gear 139 rotatable on a pin mounted in the body. The means 119 controlling the delivery of released coins is constituted by a gate or flap pivoted at 141 on a pin mounted in the body 115 for swinging movement between its first position, in which it extends up and somewhat to the left as viewed in FIG. 15 from the axis of the pin 141 with its upper end under the bottom of section 129 of the body 115, and its second position in which it extends up and to the right with its upper end over at the right side of the body adjacent the back of the housing 15. The flap 119 normally occupies its first position, in which it provides for direct downward drop or free fall of released coins in a path indicated at CB at the right of body 115 as viewed in FIGS. 15 and 18 for delivery of coins to the cash box of the vendor. In its second position, the flap intercepts released coins and directs them toward the left of the body in a path indicated at R for delivery of the coins to the return system of the vendor. The flap 119 is swingable between its stated first and second positions by mechanism comprising a cam follower lever 143 pivoted at 145 on the body 115 having a cam follower 147 riding in a cam track 149 on the other face of gear 139, and a lever 151 pivoted at 153 on the body having a notch 155 receiving a tooth 157 on the cam follower lever 143 and coupled with the flap 119 by a pin and slot connection as indicated at 159. The levers 143 and 151 are accommodated in a recess 161 at the inside of body 115 (its left side as viewed in FIGS. 11 and 13, its right side as viewed in FIGS. 12 and 17).

Figures 18, 19, 20:
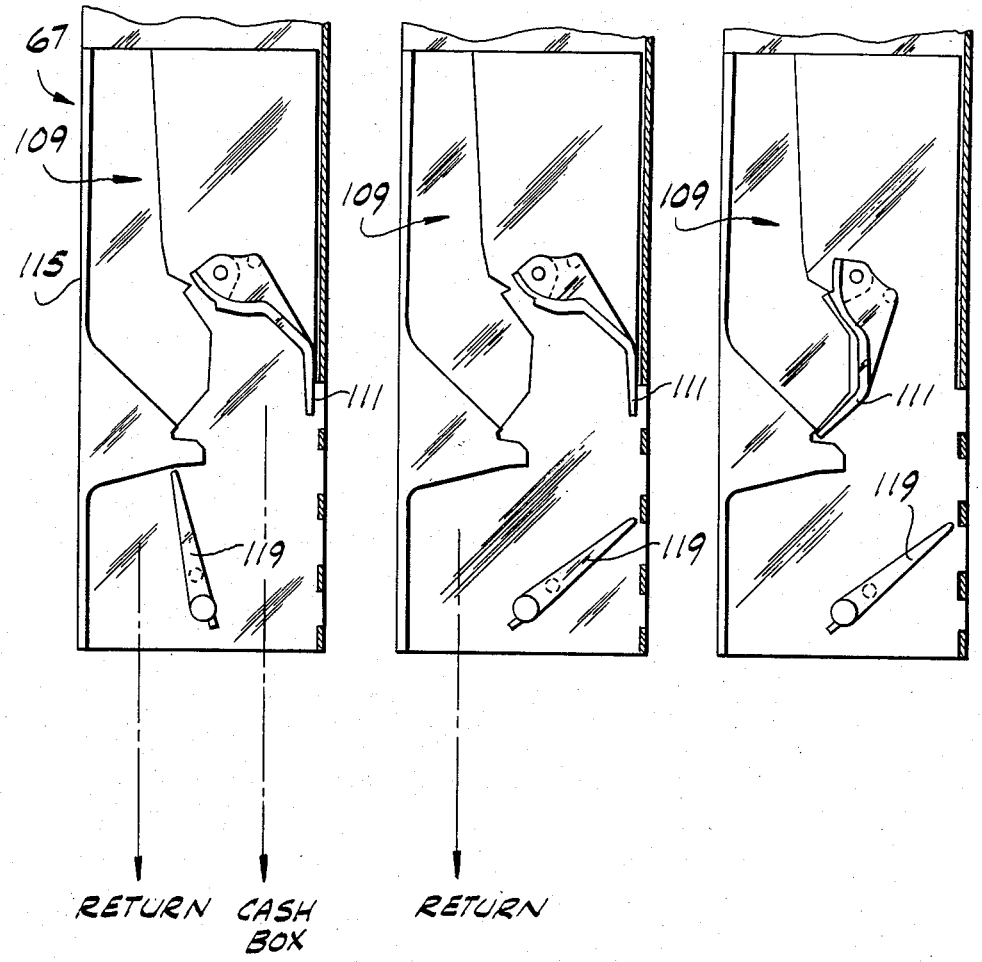
FIGS. 18-20 are views similar to FIG. 15 showing moved positions of parts.

The gear 139, constituting a double-sided face cam (track 137 on one side, track 149 on the other), is adapted to be rotated in a single-revolution cycle in one direction and in a single-revolution cycle in the other direction by a reversible motor 163 mounted adjacent the top of body 115, a speed-reducing gear train 165 being provided between the motor shaft and the gear. The cam tracks 137 and 149 are so developed that, on a revolution of the gear 139 in one direction from a home position, gate 111 opens (see FIG. 18) to release coins from escrow and flap 119 dwells in its home or "cash box" position of FIGS. 15 and 18 for an interval sufficient to allow the released coins to drop out of the escrow body 115 in path CB for delivery of the coins to the cash box. As the gear completes its rotation through the single-revolution cycle, the flap 119 swings over to its "coin return" position of FIG. 19 (after the coins have already dropped out) and then the gate 111 and flap 119 both swing back to their FIG. 15 home position. On a revolution of the gear 139 in the opposite direction from its home position, flap 119 swings to its coin return position as shown in FIG. 20 and then gate 111 opens to release coins from escrow for delivery to the return system of the vendor. As the gear completes its rotation through the single-revolution cycle in said opposite direction, the gate 111 and flap 119 return to their home position of FIGS. 15 and 18.

The detecting means 17, which may be referred to as the main checking sensor, may be of a type such as shown in U.S. Pat. Nos. 3,918,564, 3,952,851 or 3,966,034, for example, which is adapted to generate an electrical output signal indicative of the authenticity and denomination of an acceptable coin (a nickel, dime, quarter or dollar coin) rolling down on the rail member 3 in chute 9 past the sensor 17. Preferably, sensor 17 is of the type adapted for variation of the amplitude and phase of its output by a coin, the output amplitude and phase being compared with a standard. Thus, on passage of a nickel, the sensor emits what may be termed a nickel signal; on passage of a dime, it emits a dime signal; on passage of a quarter, it emits a quarter signal; and on passage of a dollar coin, it emits a dollar coin signal.

Figure 2:
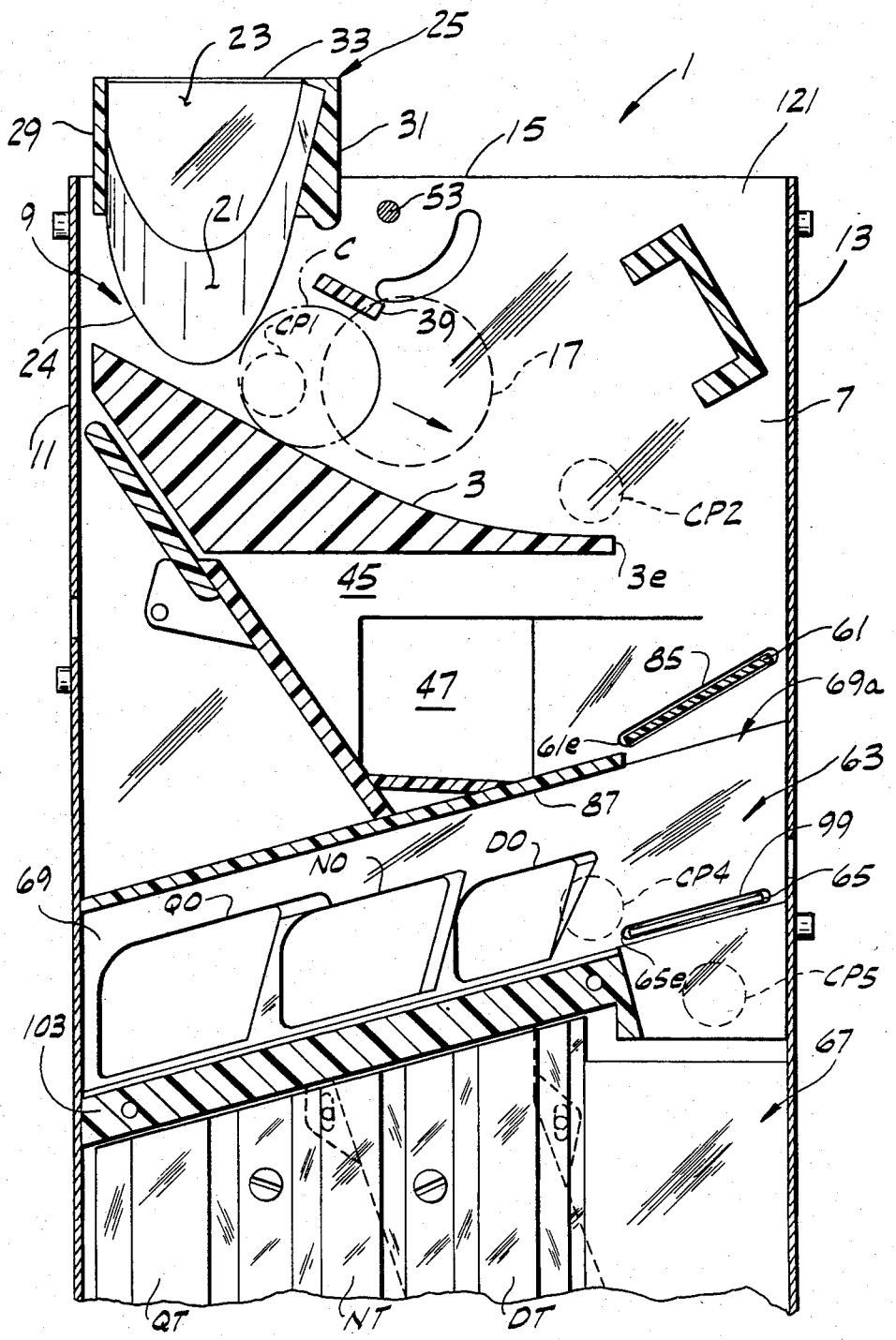
FIG. 2 is a view similar to FIG. 1 with parts removed to show interior details and with parts shown in section.

In addition to the sensor 17 the apparatus has four coin position or passage sensors designated CP1, CP2, CP4 and CP5 (see FIGS. 1 and 2). Each of these is preferably a type of sensor adapted when energized to emit an electrical signal indicative of the passage of a coin thereby.

The first coin position or passage sensor CP1 is located along chute 9 (on the rear panel 5) upstream from the main sensor 17 for sensing the entry of an item in chute 9 and the passage of the item down the chute toward sensor 17. It acts, as will appear, to enable the signaling of whether the stated item is an authentic coin and, if so, its denomination.

The second coin position or passage sensor CP2 is located along chute 9 (on the rear panel 5) downstream from the main sensor, adjacent and above the downstream (lower) end 3*e* of the rail member 3. Before an item rolling down rail member 3 in chute 9 reaches sensor CP2, the main sensor 17 will have determined if it is an acceptable coin or an unacceptable item and, if it is an acceptable coin, what its denomination is. Also, before an acceptable coin of any of the change tube denominations (nickels, dimes, quarters), reaches sensor CP2, the respective change tube sensor (NS, DS, QS) will have conditioned the apparatus for opening the gate 61 and closing gate 65 for delivery of the coin to the respective change tube (NT, DT or QT) if that change tube needs coins. Then, when the coin passes by CP2, gate 61 opens and gate 65 closes to channel the coin into the coin sorting means 69 for delivery to the respective change tube. If the change tube does not need coins, gate 65 remains open and the coin drops directly down into the escrow hopper 109.

The third coin position or passage sensor CP4 is located along the coin sorting means 69 downstream from but adjacent the downstream edge 65*e* of gate 65. It is controlled by a coin rolling off the closed gate 65 toward the left as viewed in FIGS. 1 and 2, and acts when the trailing edge of the coin passes out of the CP4 zone to effect re-closing of gate 61 and re-opening of gate 65. It also acts to signal that the coin has been delivered to the respective change tube.

The fourth coin position or passage sensor CP5 is located just below the second gate 65 at the entrance onto the escrow hopper 109. It is controlled by a coin falling past the open gate 65 into the hopper and acts as the leading (lower) edge of the coin comes into the CP5 zone to effect re-closing of gate 61 and as the trailing (upper) edge of the coin travels down past said zone to signal that the coin has passed into escrow.

Figure 21B:
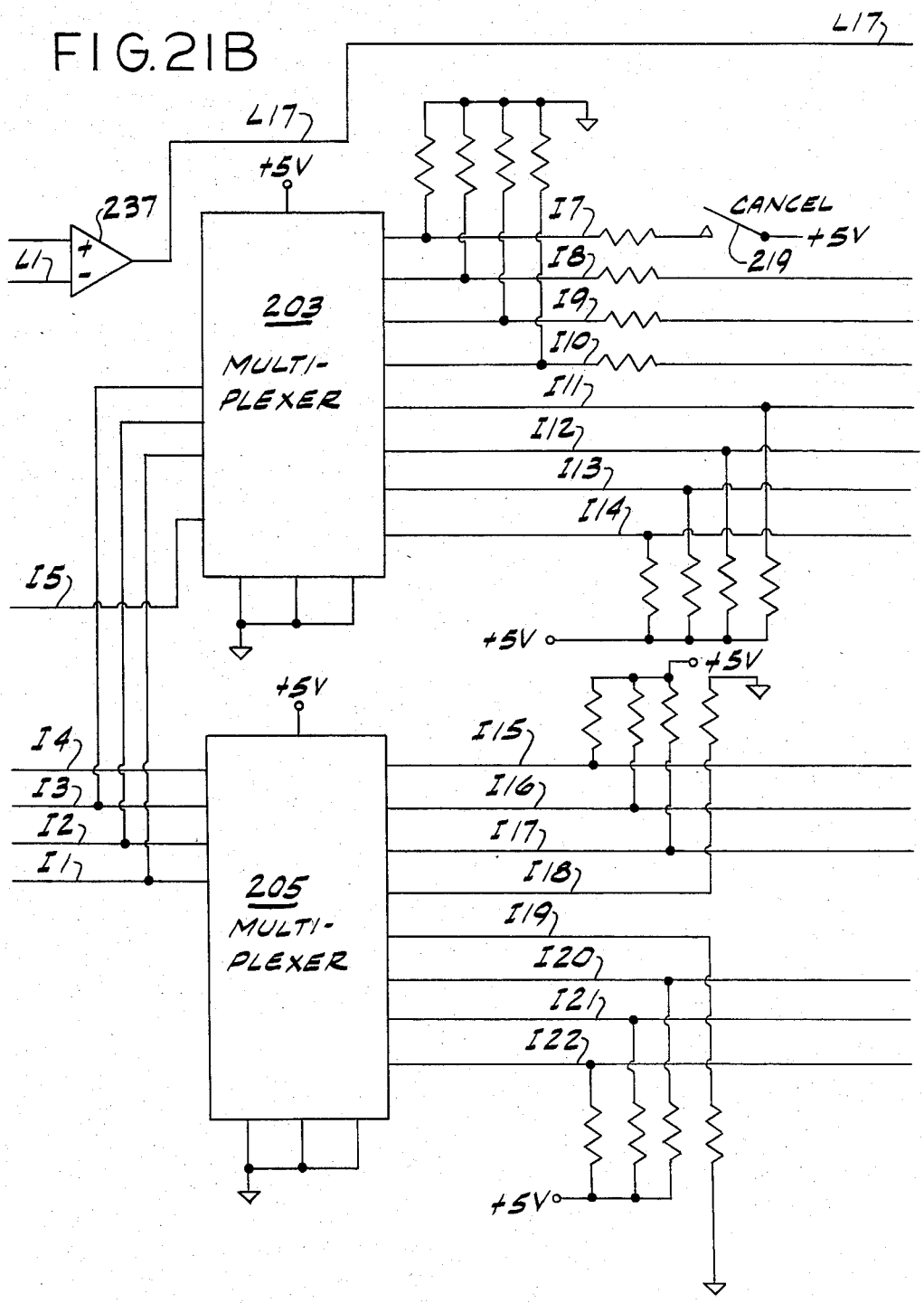
Figure 21C:
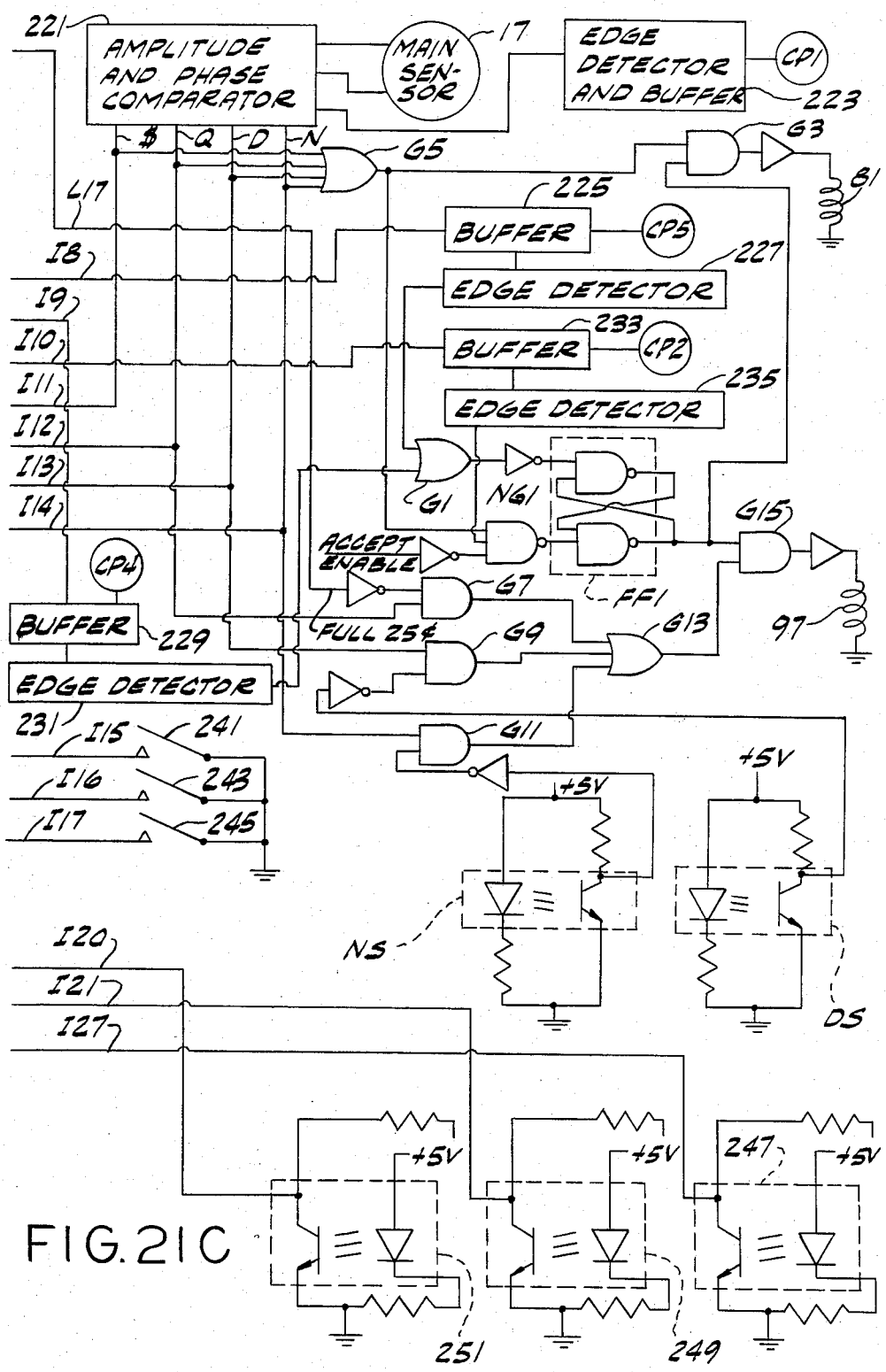
Figure 21D:
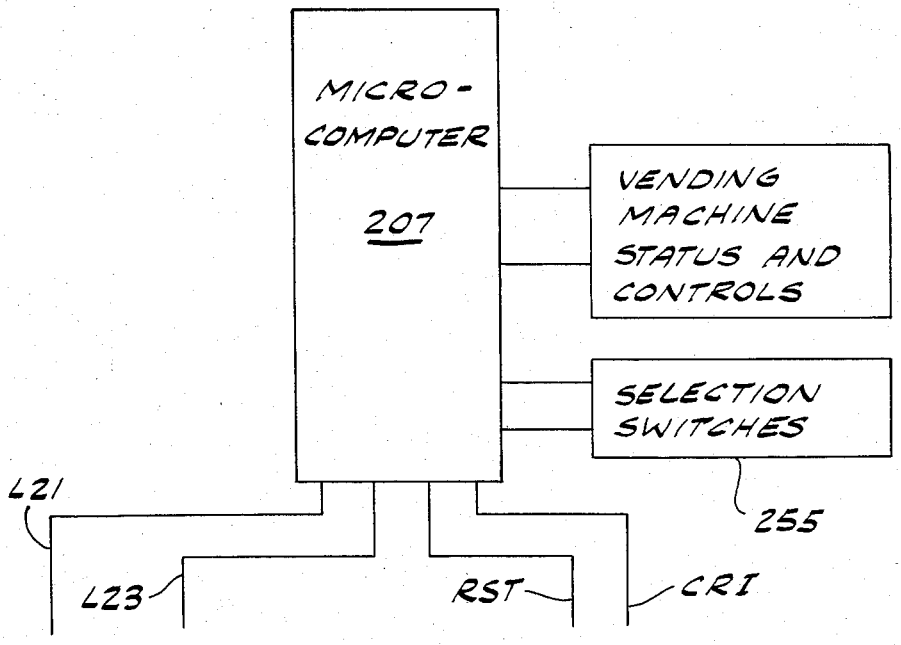

The electrical circuitry for coin apparatus 1 (see FIGS. 21A–21D) includes a microcomputer 201 for handling logic functions for the apparatus (FIG. 21A), a pair of multiplexers 203, 205 for supplying various status inputs to microcomputer 201 (FIG. 21B), various sensors and logic circuitry used in controlling the accept/return gate 61 and the coin sorting/escrow gate 65 (FIG. 21C), and a second microcomputer 207 for computing credit, amounts and types of change, and the like (FIG. 21D).

More particularly, microcomputer 201, which is preferably a Motorola MC 6805 integrated circuit, has a buffered input line SI over which it receives serial information from microcomputer 207, a buffered output line SO over which it sends serial information to microcomputer 207, a reset line RST over which microcomputer 207 can reset mirocomputer 201 as necessary, and a control line CRI over which microcomputer 207 sends commands to microcomputer 201 to start accepting money or to stop accepting money. Microcomputer 201 is also connected to a sensor 209, reversible escrow motor 163, dc coin ejector motors 211, 213 and 215 for actuating ejector means 73 to eject nickels, dimes and quarters from the change tubes, and to an accept/enable line, labelled 217, of the coin apparatus. Microcomputer 201 addresses the multiplexers over three lines I1–I3 and receives data from the multiplexers over two input lines I4–I5 and has an additional output line L1 over which it supplies data to the gate control logic of FIG. 21C.

Figure 15:
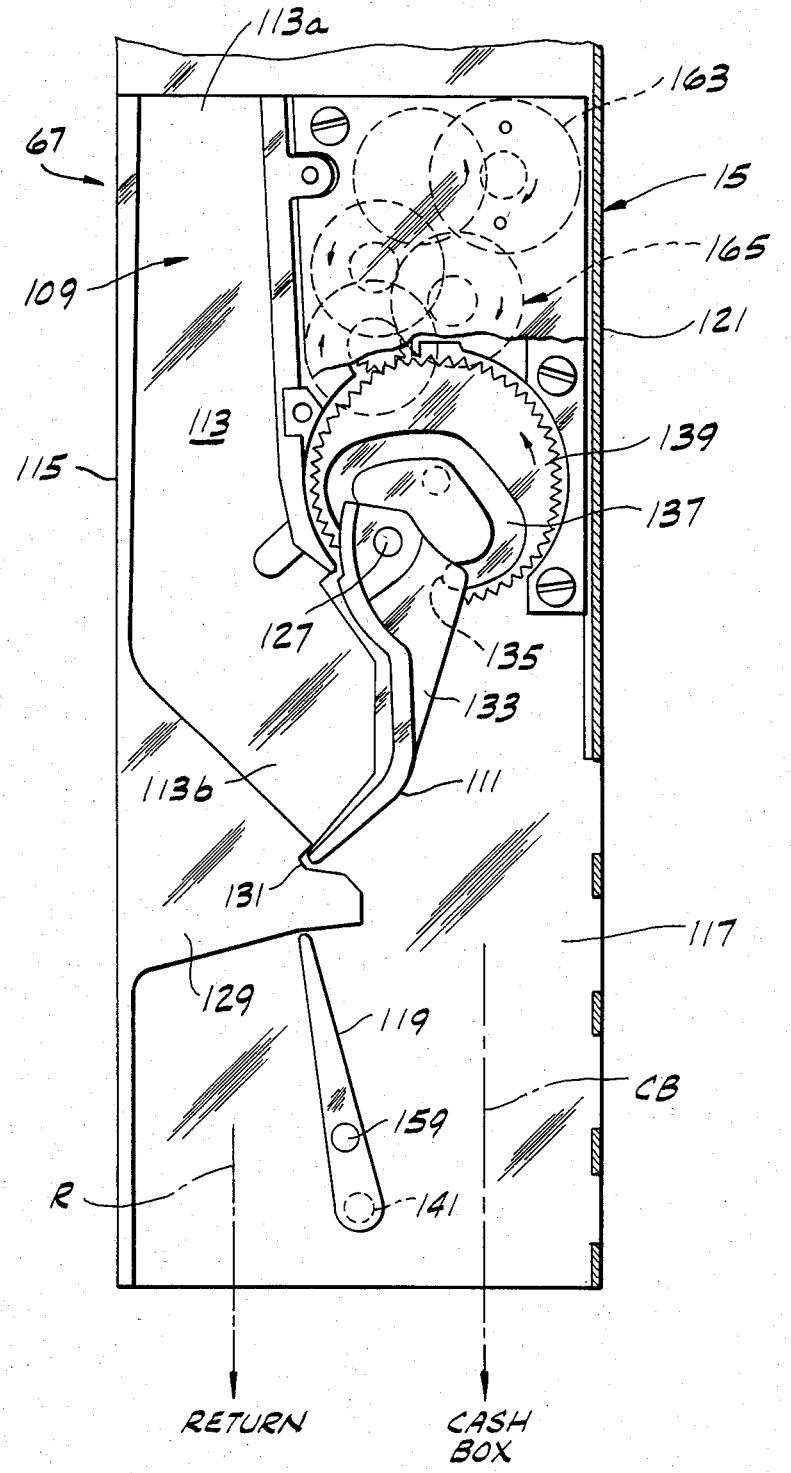
FIG. 15 is a view on line 15—15 of FIG. 12.
Figure 16:
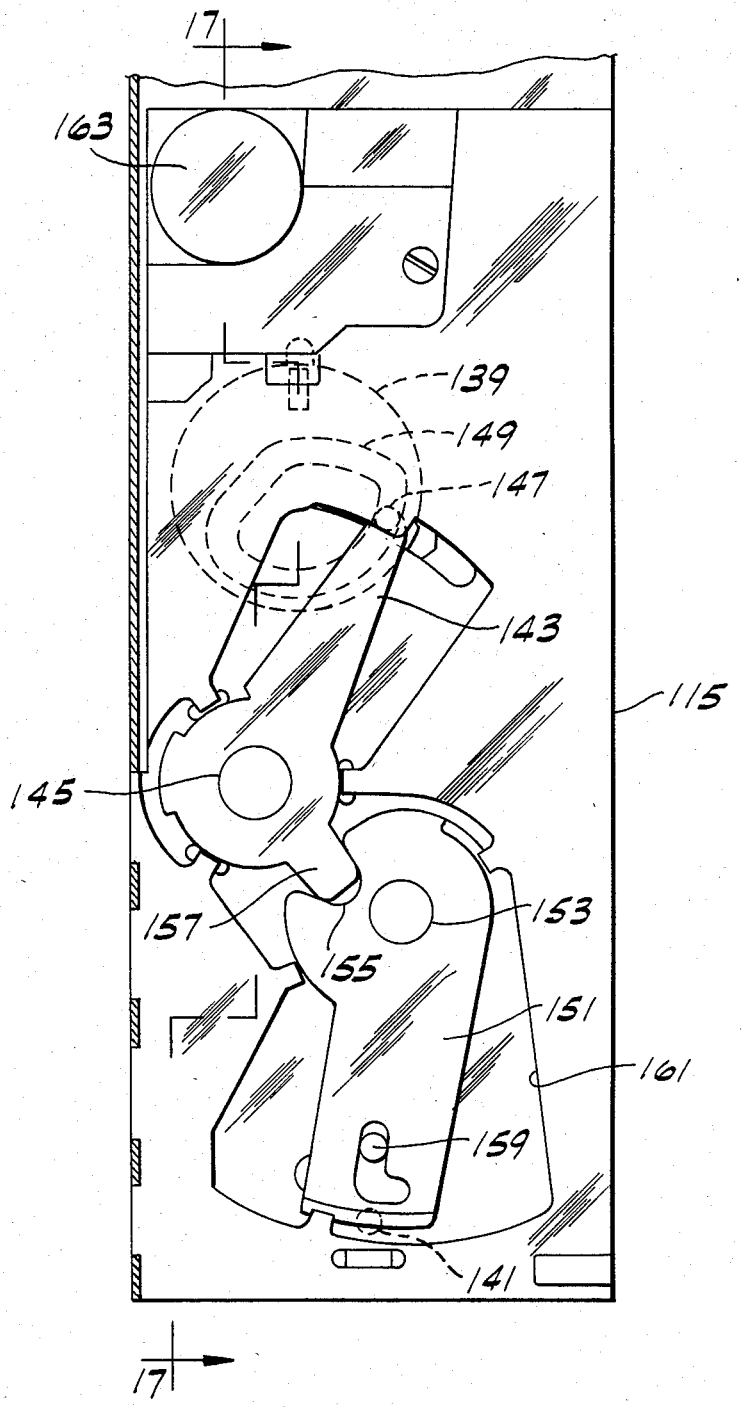
FIG. 16 is a view on line 16—16 of FIG. 12.

Sensor 209, shown as a simple switch, detects when escrow motor 163 is in its home position, that is, it detects when the position of the escrow motor in its rotation is such that flap 111 and flap 119 are in the position shown in FIG. 15. The escrow motor itself is controlled by microcomputer 201 over two lines L3 and L5. If line L3 is High and line L5 is Low, escrow motor 163 rotates in one direction, e.g. clockwise. If the polarities are reversed, motor 163 rotates in the other direction, e.g. counterclockwise. And if lines L3 and L5 are both High or both Low, motor 163 stops. Ejector motors 211, 213, 215 are similarly controlled by microcomputer 201 over three lines L7, L9 and L11, as is the accept/enable line over a line L13. The outputs of microcomputer 201 over lines L3, L5, L7, L9, L11 and L13 are all inverted and buffered to provide a current sink for the associated motors and coils. For example, a High output on one of lines L7, L9 or L11 causes its associated coin ejector motor to be energized. Likewise a Low on line L13 energizes the accept/enable line.

Multiplexers 203 and 205 (FIG. 21B), as stated above, supply inputs to microcomputer 201 via lines I4–I5. The multiplexers in turn receive these inputs over a number of lines labelled I7–I22. The input on line I7 to multiplexer 203 indicates whether the customer has pressed the cancel vend switch, labelled 219; the inputs on lines I8–I10 represent the buffered outputs of sensors CP5, CP4 and CP2 respectively; and the inputs on lines I11–I14 represent the deposit of dollar, quarter, dime and nickel coins respectively into the apparatus. The inputs to multiplexer 205 include signals representing whether the nickel, dime and quarter coin ejector motors are in the home, i.e., non-ejecting, positions, which signals come over lines I15–I17 respectively; and signals over lines I20–I22 representing whether the quarter, dime and nickel change tubes respectively are empty. When a dollar coin tube is used, signals representing the home position of the dollar coin ejector motor and the empty condition of the dollar coin tube would come over lines I18 and I19. In the embodiment shown in FIG. 21B these dollar coin inputs are tied Low, which prevents the microcomputers from trying to eject a dollar coin in change.

Detecting means or main sensor 17 (FIG. 21C), which identifies the denominations of coins in chute 9 and detects unacceptable items, is connected to an amplitude and phase comparator circuit 221, such as those shown in the above-mentioned U.S. patents. Circuit 221 has four outputs, labelled $, Q, D, and N which when High indicate that the denomination of the coin in chute 9 in the vicinity of sensor 17 at that time is a dollar, a quarter, a dime, or a nickel respectively. To ensure that the signal from circuit 221 represents the denomination of the correct coin, a signal from sensor CP1 is buffered by an edge detector and buffer circuit 223 and supplied to circuit 221 as an enable signal. This enable signal ensures the proper timed relationship between the passage of a coin past sensor CP1 down chute 9 and the identification of its denomination by main sensor 17. Outputs $, Q, N and D are supplied over lines I11–I14 to multiplexer 203.

The output of sensor CP5, which detects the presence of a coin below the coin sorting/escrow gate, is supplied to a buffer 225 which converts the signal to one having voltage levels compatible with the logic circuits and the multiplexers. The output of buffer 225 is supplied to multiplexer 203 (by line I8) and to an edge detector 227. Edge detector 227 detects when the trailing edge of a coin passes sensor CP5, which indicates that the coin is going to the escrow system, and when this occurs its output goes High. This High output is supplied to an OR gate G1. Similarly, the output of sensor CP4 is supplied through a buffer 229 to edge detector 231 and, via line I9, to multiplexer 203. The output of edge detector 231 is High when the trailing edge of a coin passes CP4, which indicates that the coin is going to the coin sorting tubes. This output is also supplied to gate G1. The output of gate G1 is High, therefore, whenever a coin passes either sensor CP4 or sensor CP5. The output of sensor CP2 is also buffered, by a buffer 233 and supplied via line I10 to multiplexer 203 and to an edge detector 235.

Accept/reject gate 61 is controlled by solenoid 81, which when energized opens the gate. Solenoid 81 is in turn controlled by the output of an AND gate G3 whose inputs are the output of a flip-flop FF1 and the output of an OR gate G5. The inputs to gate G5 are the denomination signals from circuit 221, so a High output of gate G5 indicates that the item is a valid nickel, dime, quarter or dollar. The output of flip-flop FF1 is determined, in part, by sensor CP2. The output of edge detector 235 goes High when a coin passes sensor CP2. This High output of edge detector 235 is supplied to a NAND gate NG1 whose other inputs are the inverted logic level on the accept/enable line and the output of OR gate G5, which when High represents the fact that an acceptable coin has passed sensor 17. When the item which passes sensor CP2 is an acceptable coin and the accept/enable line is Low, the output of gate NG1 goes Low. This Low is supplied to the set input of flip-flop FF1, whose output thereupon goes High. Thus, the High output of flip-flop FF1 indicates a valid coin has passed sensor CP2. This High is supplied to AND gate G3 to energize solenoid 81 and open accept/reject gate 61. The coin thereupon passes through gate 61 into accept system 63. Conversely, when the item is not a valid coin, the output of OR gate G5 stays Low, which makes the output of AND gate G3 stay Low, and accept/reject gate 61 stays closed. The unacceptable item strikes gate 61 and rolls down return chute 45 to the return system.

Once an acceptable coin does pass through gate 61, it must be sent either to the escrow system or to the change tubes. This decision is based upon whether or not that particular coin is needed in the change tubes. With the present invention, whether a particular denomination coin is needed in the change tubes can be controlled by either hardware or software. For example, quarter sensor QS (FIG. 21A) senses when quarters in the quarter tube are stocked to some predetermined level, such as eighty-eight quarters. When eighty-eight quarters are present in the quarter tube, the output of sensor QS is High. This High (e.g., 5 V) output is supplied to the non-inverting input of an op amp 237 (FIG. 21B). On the other hand, when the quarter tube is not full, the output of sensor QS is Low and the voltage on the non-inverting input of op amp 237 is about 1.8 V. The inverting input of op amp 237 is connected via line L1 to microcomputer 201. When the full status of the quarter tube is under hardware control, line L1 stays High, so the non-inverting input of op amp 237 is approximately at 2.5 V, and the output of op amp 237 follows the input from quarter sensor QS. When, on the other hand, it is decided to control the level of quarters by software, line L1 will not always be High. In this latter case, line L1 will stay High only until the number of quarters in the quarter tube reaches a level, e.g., fifty quarters, which is predetermined by the software. At that time, line L1 goes Low, causing 0.0 volts to appear on the inverting input of op amp 237. Since the non-inverting terminal of the op amp is always at least at 1.8 V, this Low on the inverting input causes the output of op amp 237 to go High, signalling that the quarter tube is full. The output of op amp 237 is supplied over a line L17 to the gate control logic of FIG. 21C. More particularly, the output is inverted and then supplied to an AND gate G7. The other input to gate G7 is the quarter output from amplitude and phase comparator circuit 221. When the coin sensed by main sensor 17 is a quarter, and the quarter tube is not full gate G7 is High. Otherwise it is Low. Thus, the output of gate G7 is High only if the coin detected is a quarter and a quarter is needed in the change tubes.

In the embodiment shown, the nickel and dime change tubes are not software controlled. In the case of these two denominations the outputs of full tube sensors DS and NS are inverted and supplied to a pair of AND gates G9 and G11 respectively. The other input to AND gate G9 is the dime signal from circuit 221 and the other input to AND gate G11 is the nickel signal from circuit 221. Thus, a High output of AND gate G9 represents the fact that an accepted coin is a dime and that it is needed in the dime change tube and a High output of AND gate G11 represents the corresponding situation for a nickel. The outputs of these gates and gate G7 are supplied to an OR gate G13, whose High output represents that the coin being sensed is needed in the change tubes and, hence, coin sorting/escrow gate 65 should be closed to cause the coin to roll down the coin sorting chute. The output of 5R gate G13 is supplied to an AND gate G15 whose High buffered output drives solenoid 97 to close coin sorting/escrow gate 65.

The output of gate G15 is High whenever the item being sensed is a valid coin (which fact is represented by the High output of flip-flop FF1) and that the coin is needed in the change tube (which is shown by the High output of gate G13). Note that in the case of a dollar coin the output of gate G13 cannot be High, so solenoid 97 remains deenergized and the dollar coin drops directly into the escrow hopper.

Once the coin has fallen below the coin sorting/escrow gate or has rolled down the coin sorting chute, it is necessary to return accept/reject gate 61 and, possibly, coin sorting/escrow gate 65 to their original positions in preparation for the next coin. This is accomplished by using the outputs of sensors CP4 or CP5 as the case may be to reset flip-flop FF1. When the coin passes down the coin sorting chute, edge detector 231 signals the passage of its trailing edge past sensor CP4 by going High. This High is supplied to OR gate G1, causing its output to go High, which resets flip-flop FF1. The resulting Low output of flip-flop FF1 causes solenoids 81 and 97 to be deenergized, thereby insuring that accept/reject gate 61 is closed and that coin sorting/escrow gate 65 is open. Likewise if the coin passes instead into the escrow hopper, the passage of its trailing edge past sensor CP5 also causes the output of OR gate G1 to go High, resetting flip-flop FF1. This closes accept/reject gate 61 but does not affect the status of coin sorting/escrow gate 65 since it is already open.

Also shown on FIG. 21C are three position sensing switches 241, 243, and 245 which sense the home positions of the nickel, dime and quarter coin tube ejector motors and three optoelectronic sensors 247, 249, and 251 for sensing when the nickel, dime and quarter tubes respectively are empty. The closed position of switches 241, 243 and 245 represents the home position of the associated coin ejector motors. The signals from switches 241, 243, 245 and from sensors 247, 249 and 251 are supplied over lines I15–I17 and I20–I22 to multiplexer 205.

Microcomputer 207 (FIG. 21D), which is preferably an Intel 8051 integrated circuit, controls the functioning of the apparatus such as a vending machine in which coin apparatus 1 is installed. The various vending machine devices and sensors controlled or read by microcomputer 207 are indicated by the block labelled Vending Machine Status and Controls. The input from a set of selection switches 255 by means of which a customer can select an item to be vended is shown separately.

The operation of the circuitry of FIGS. 21A–21D may be understood by referring to the flowcharts for microcomputers 207 and 201 shown in FIGS. 22A–22C and 23A–23B respectively. Microcomputer 207 performs many vending machine control functions which are of no relevance to this invention. These functions are labelled Standby Routine. What is relevant to this invention are the coin handling and selection switch routines of microcomputer 207. Starting with the coin handling routine (FIGS. 22B–22C), microcomputer 207 first receives information that a coin has been deposited when the coin passes sensor CP4 (if it is going to the change tubes) or sensor CP5 (if it is going into the escrow hopper). Microcomputer 201 sends this information, along with the denomination of the coin, via serial output line SO, an op amp 261, and a line L21 to microcomputer 207. The denomination of the coin deposited and its destination is transmitted over lines SO and L21 at 600 baud and the transmission takes less than 0.02 second. For clarity, the entire transmission of a 0.02 second signal from over these lines is represented on FIG. 22B by the legend Serial Link Interrupt-Message Received from Micro 201. Once the transmission is complete, microcomputer 207 recognizes it as an interrupt. Of course if the coin gets stuck in the apparatus prior to passing sensor CP4 or sensor CP5, no coin handling sequence will start in microcomputer 207. The customer will eventually press the scavenge or cancel switch which, as explained above, causes the jammed coin to enter the return system of the apparatus.

Assuming the message is sent to microcomputer 207 that a specified denomination coin has passed sensor CP4 or sensor CP5, microcomputer 207 then examines the message to determine if the coin went to the change tubes. When that is the case, microcomputer 207 then increments a counter for that particular denomination coin. There are three such counters—one for nickels, one for dimes, and one for quarters—and each is cleared before each new transaction so that their contents always represent the number of coins deposited by a customer for a particular transaction which go to the change tubes. This information is used to keep track of the actual number of quarters in the quarter change tube and to return to the customer, if the vend is cancelled, the exact number and type of coins he deposited into coin apparatus 1. After incrementing the appropriate counter, microcomputer 207 then updates a total representing the number of quarters in the quarter tube. If the coin which went to the coin tube was a quarter, the quarter tube total is incremented and the total compared with a software-determined target figure (see FIG. 22C). If the quarter total is greater than the target, microcomputer 207 sends a message over a line L23, a comparator 263, and serial input line SI to microcomputer 201 to stop sending quarters to the coin tubes. Once this is done, microcomputer 207 adds the value of the quarter to the customer's credit, checks the status of the coin tubes and returns to standby.

If the quarter total was not over the target value, microcomputer 207 performs the same steps as outlined above except that no message is sent to microcomputer 201 to stop sending quarters to the coin tubes. Similarly, if the coin going to the change tubes is not a quarter, microcomputer 207 immediately adds the value of the coin to the customer's credit, updates the status of the coin tubes and returns to standby. In those cases where the accepted coin goes to the escrow hopper instead of the coin tubes, microcomputer 207 identifies the message from microcomputer 201 as a coin-to-escrow message, updates the customer's credit and the coin tube status, and returns to standby.

After inserting one or more coins into apparatus 1, the customer may decide to recall his money. This causes a second serial link interrupt, the cancel interrupt. In the interrupt sequence, microcomputer 207 again checks the message to see if it was a coin to change tubes or coin to escrow message. If not, it updates the coin tube status and checks to see if the message was a cancel message. If so, it signals microcomputer 201 over lines L23 and SI to return the money held in the escrow hopper and it begins to return to the customer the number and type of coins he inserted that went into the change tubes. This is done by sending a message or messages to microcomputer 201 instructing it to return to the customer the same number and denomination of coins which he deposited to the coin tubes. Then microcomputer 207 returns to the standby routine.

If the customer does not decide to recall his money, the next operation he might perform is to select an item to be vended by pressing a selection switch. This generates a selection switch interrupt, the flowchart for which is shown in FIG. 22A. After signalling microcomputer 201 to disable the accept/enable line, microcomputer 207 identifies the switch selected. It then determines the price of the selected item and subtracts this price from the customer's accumulated credit to see if the customer has sufficient credit to purchase the item. If the customer's credit does not exceed the price of the selected item, microcomputer 207 returns to its standby loop. On the other hand if the credit does exceed the price, microcomputer 207 determines if change can be made for the requested vend by examining the change tube status data acquired in the coin handling sequence. If change can not be made, microcomputer 207 returns to the standby loop to await a cancel by the customer. Alternatively, microcomputer 207 can signal the customer by indicator lights or the like that change cannot be made. If change and a vend can be made, however, microcomputer 207 signals microcomputer 201 to accept the coins in the escrow hopper and then checks the customer's remaining credit to see if it is zero. If the customer is not due any change, microcomputer 207 returns to standby. If change is due, microcomputer 207 signals microcomputer 201 to return the proper coins in change. After the message to pay out coins in change is sent, the customer's credit is decremented to zero, and microcomputer 207 returns to standby.

Microcomputer 201 must respond to all the above requests by microcomputer 207. To do so it follows the flowchart of FIGS. 23A–23B, which it completed every 1.66 msec. The data from the multiplexers is updated by microcomputer 201 during each pass through its program. Every time after the multiplexers are read by microcomputer 201, it examines line CRI to determine if microcomputer 207 is requesting that the accept/enable line be energized or deenergized. If the accept/enable line is to be energized, microcomputer 201 accomplishes this by appropriately changing the voltage on line L13. After energizing the accept/enable line, which stops additional coins from being accepted, microcomputer 201 checks to see if it has given microcomputer 207 the current status of the change tubes. If it has, it continues through the main path of the program. If it has not, it checks to make sure that the last coin has cleared the system and if it has cleared the system it sends microcomputer 207 the current tube status. If the last coin has not cleared the system; microcomputer 201 returns to the main path of the program without notifying microcomputer 207 of the current tube status. After a short time, of course, since microcomputer 201 completes its entire program in 1.66 msec., the last coin inserted before energization of the accept/enable line does clear the system and microcomputer 201 does send the coin tube status information to microcomputer 207.

On those passes through the program when microcomputer 201 is not signalled over line CRI to energize the accept/enable line, after it checks line CRI microcomputer 201 examines its buffers to see if all required coin payouts have been completed. If they have then the apparatus is ready for another transaction and microcomputer 201 de-energizes the accept/enable line so that coins can again be accepted. If a payout is not complete, this means that the accept/enable line has previously been energized and should remain energized until payout is complete. Microcomputer 201 in this latter case maintains the accept/enable line energized and continues through the program.

The next step in microcomputer 201's program is determining if the cancel switch has been pressed. If the switch has been pressed, it sends a message to this effect to microcomputer 207 over line SO. Next, microcomputer 201 determines if any of the motors under its control (for example the coin ejector motors) are running by checking the voltage levels on lines L3, L5, L7, L9 and L11. If a motor is running, microcomputer 201 then checks multiplexer 205 to see whether that motor is in its home position and if so turns the motor off.

After turning off any running motors which are in the home position, microcomputer 201 again looks at multiplexer 203 to see if there is a coin passing and being identified by sensor 17. If there is, the value of that coin is stored in memory. Next, multiplexer 203 is read to see if a coin is passing sensor CP4. If one is, microcomputer 201 sends a message to microcomputer 207 stating the denomination of the coin (which was stored in memory as the coin passed sensor 17) and the fact the coin has gone to the change tubes. At this time a message representing the current status of the change tubes is also sent to microcomputer 207.

The next step in microcomputer 201's program is reading, via multiplexer 203, the status of sensor CP5. If a coin is passing this sensor, that means it is going to the escrow hopper. This information, along with the value of the coin and the status of the change tubes, is sent to microcomputer 207. Then microcomputer 201 examines any messages it has received from microcomputer 207. If it has received such a message, it adjusts the quarter tube control status, if necessary, by changing the voltage on line L1. If the message also contains an order to operate the escrow motor or the change tube ejector motors, this information is stored.

Next microcomputer 201 attempts to pay back any coins from the change tubes or money in the escrow hopper which microcomputer 207 had previously ordered to be paid back. This is done by checking multiplexer 205 to see if the desired coin ejector motors are in the home position. If the desired motors are not in the home position, pay back is postponed until the next pass (or some other subsequent pass) through the program. If the desired motors are in the home position they are energized via lines L3, L5, L7, L9 and L11 as necessary to return the coins to the customer. Then microcomputer 201, if previously so ordered by microcomputer 207, starts a routine to accept any money in the escrow hopper. This routine, like the payback routine, involves checking to see if the escrow hopper motor is in the home position and, if it is, energizing the escrow hopper motor to accept the coins it contains. Then microcomputer 201 returns to the start of its program.

It should be appreciated from the above description, that the circuitry of FIGS. 21A–21D does not have to use any microcomputers. Discrete logic circuits could be used. And it does not have to use two microcomputers. The functions of microcomputer 201 and microcomputer 207 could be combined and performed on a single microcomputer.

In illustration of the operation of the apparatus, assume that a customer deposits a dollar coin, a quarter, a dime and a nickel in the vendor for purchase of an item selling at $1.40 (meaning that no change is needed), and that all three of the change tubes NT, DT and QT are full (i.e., each change tube is stocked with coins to the level of the respective sensor NS, DS, QS). As each coin rolls down on the rail member 3 in the first chute 9, it first passes sensor CP1 thereby enabling the output of amplitude and phase comparator circuit 221 which on passage of the coin past detector means or main sensor 17 delivers a signal via the respective output $, Q, D, N of circuit 221 (in accordance with the denomination of the coin). As the coin passes sensor CP2, gate G3 energizes solenoid 81 to open the accept/return gate 61. Since the change tube for that coin does not need any additional coins, solenoid 97 for the coin-sorting/escrow gate 65 remains deenergized, gate 65 stays open, and the coin drops into the escrow hopper 109, in which it is retained by the closure or release gate 111. Since (in this example) none of the change tubes need coins, the nickel, dime and quarter as well as the dollar drop into the escrow hopper and remain there pending a vend or a recall by the customer. As each coin drops past sensor CP5, the latter delivers a signal via gate G1 to reset flip-flop FF1 for deenergizing solenoid 81 for closing of gate 61 (under the bias of spring 91). It also delivers a signal via line I8, multiplexer 203, and microcomputer 201 to microcomputer 207 for crediting the customer with the amount of the coin and indicating that the coin passed into the escrow hopper.

Assuming the customer then operates a selection switch of the vendor for obtaining the stated $1.40 item, microcomputer 207 follows the steps of the selection switch interrupt flowchart (FIG. 22A). In this example, there is no change due the customer, so microcomputer 207 simply signals microcomputer 201 to accept the escrowed coins and, returns to its standby loop.

Figure 22C:
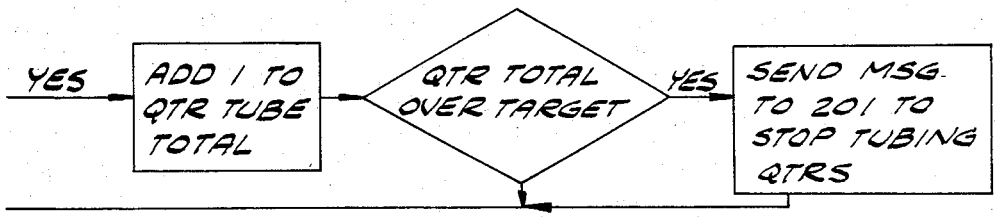
FIGS. 22A-22C are flowcharts for a microcomputer used in the circuitry shown in FIGS. 21A-21D.
Figure 22A:
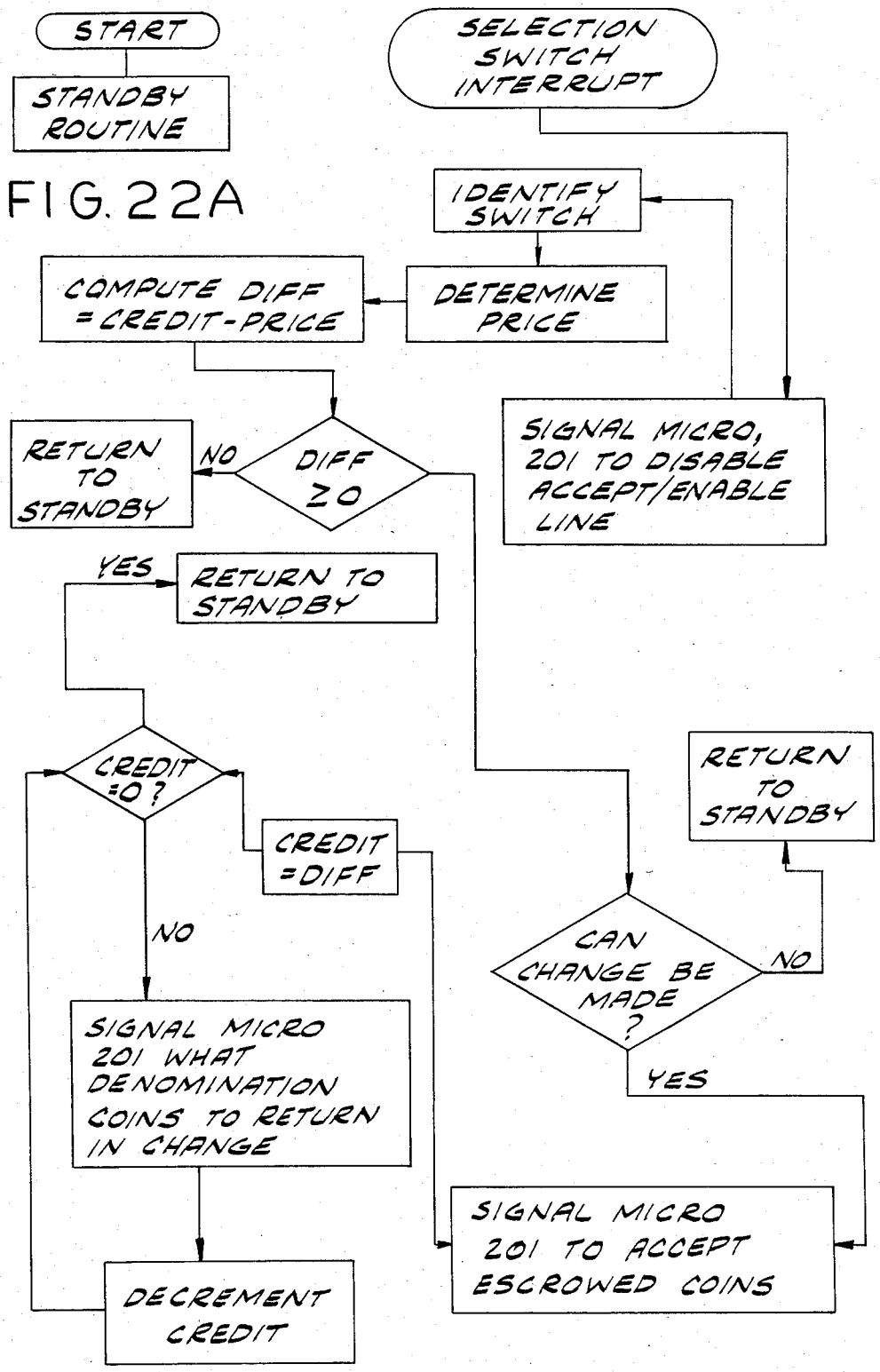

Assuming, however, that the customer changes his mind and operates the coin return or cancel switch 219 of the vendor, microcomputer 201 signals this fact to microcomputer 207 over line SO which initiates the cancel routine of the latter (FIG. 22C). In the cancel routine, microcomputer 207 signals microcomputer 201 to return the escrowed money and to deenergize the accept/enable line so that additional coins can be accepted for the next transaction. Microcomputer 201 appropriately energizes lines L3 and L5 to energize escrow motor 163 for rotation in the proper direction and controls the accept/enable line over line L13. Microcomputer 207 returns to its standby loop, since in this example all of the customer's coins went to the escrow hopper initially and none went to the change tubes.

Next, assume the same conditions as the above except that one of the change tubes, e.g., the nickel change tube NT, needs coins. The operation will be the same as above described except that in response to the nickel passing sensor CP2, solenoid 97 will be energized to close the coin-sorting/escrow gate 65, and the nickel, after falling past the opened gate 61, strikes the closed gate 65 and rolls off to the left into the coin sorting chute, from which it drops out through opening NO into the nickel change tube NT. As the nickel, rolling off gate 65, passes sensor CP4, a signal is delivered via gate G1 to reset flip-flop FF1, which deenergizes solenoid 81 for closure of gate 61 and deenergizes solenoid 97 for opening gate 65 (by spring 107). A signal is also supplied from sensor CP4 via line I9, multiplexer 203 and microcomputer 201 to microcomputer 207 for crediting the customer with the deposit of the nickel and indicating that the nickel has entered the coin sorting means for delivery to the nickel change tube NT.

Assuming the customer then operates a selection switch of the vendor for obtaining the stated $1.40 item, the operation is the same as before except that the nickel, instead of going to the cash box, is retained in the nickel change tube NT.

Assuming the customer changes his mind and operates the coin return or cancel switch 219 of the vendor, the dollar, quarter and dime are returned to him from the escrow hopper as in the previous example, and a nickel (but not necessarily the same as the one he deposited) is returned to him from the nickel change tube NT. To return a nickel to the customer, microcomputer 207 signals microcomputer 201 over serial input line SI to eject a nickel from the nickel change tube. Microcomputer 201 does this by energizing nickel coin ejector motor 211 until that motor returns to its home position.

Figure 22B:
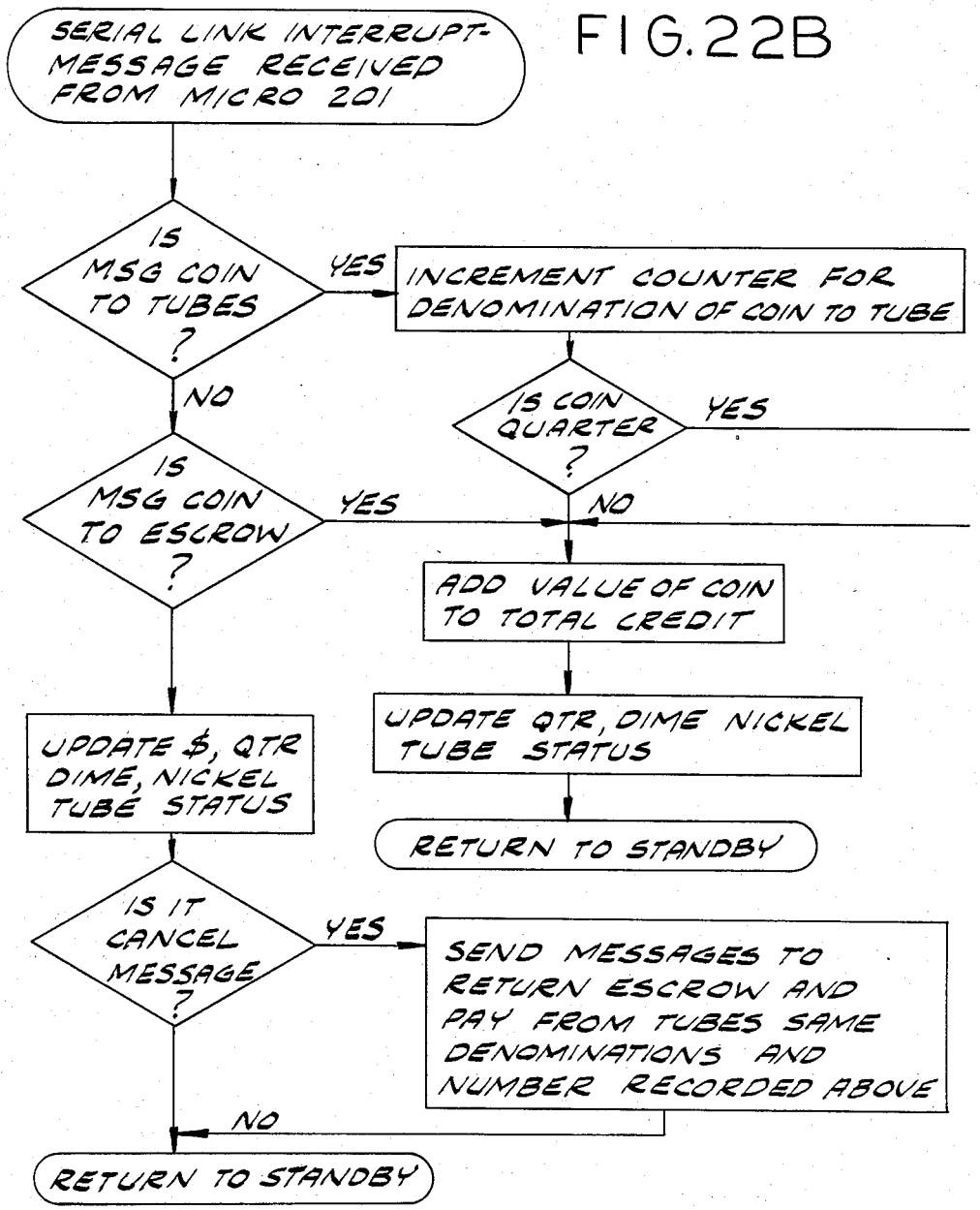
Figure 23A:
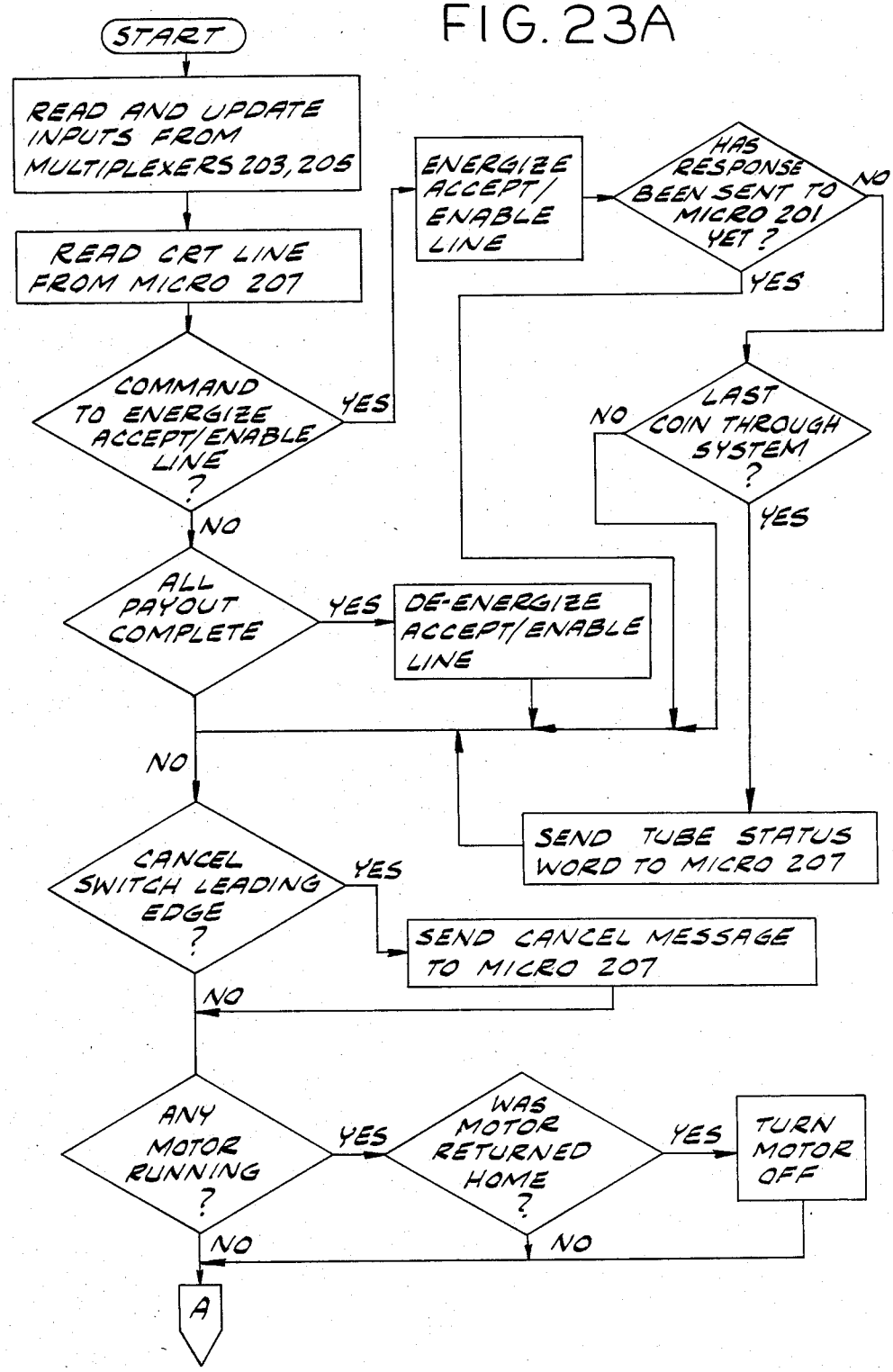
FIGS. 23A-23B are flowcharts for another microcomputer used in the circuitry shown in FIGS. 21A-21D.
Figure 23B:
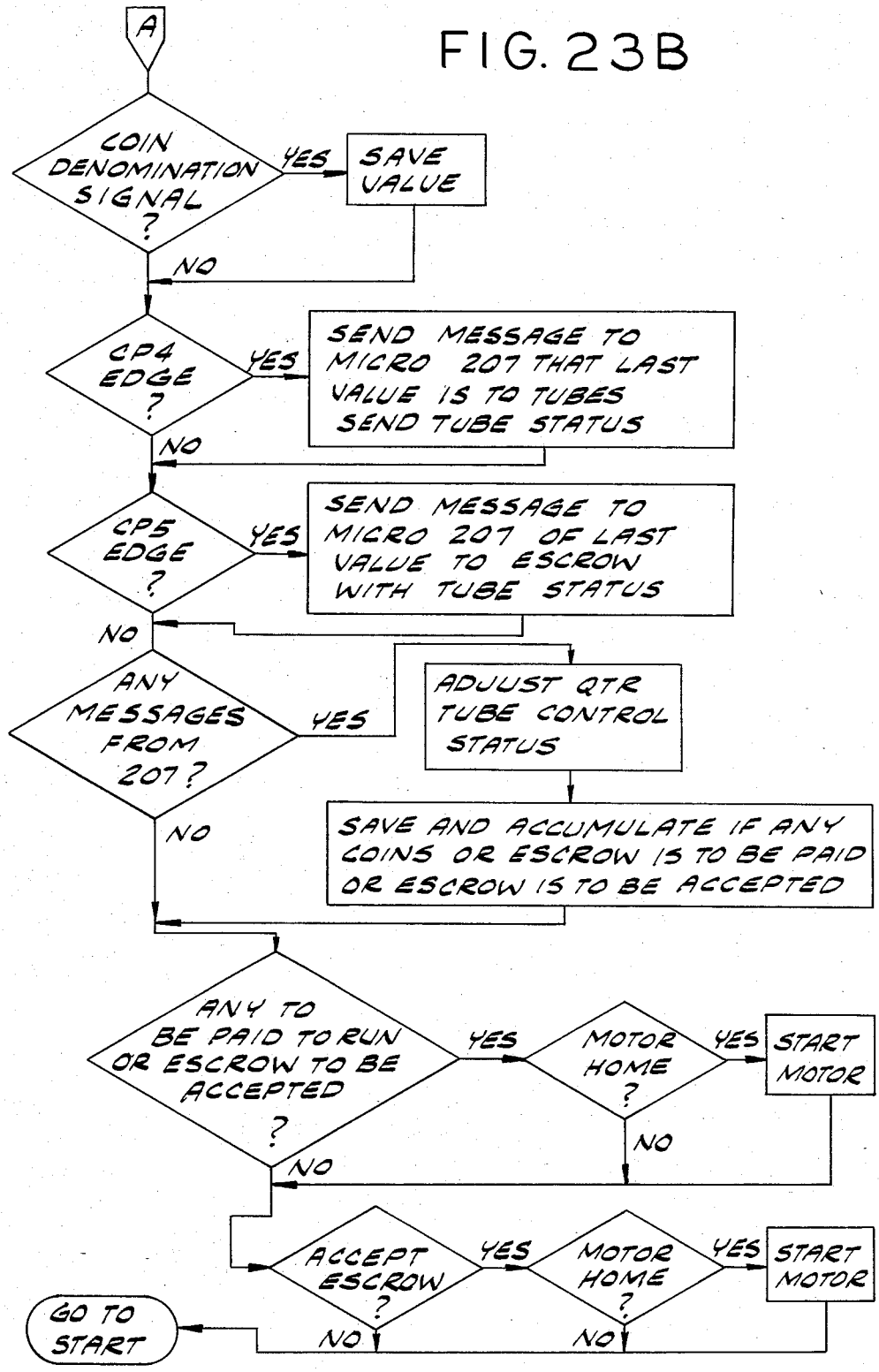

Assuming the customer deposits a dollar coin, a quarter and a dime ($1.35) for the purchase of a $1.30 item (meaning that a nickel in change is required), the operation is similar to that above described except that, on operation of the selector switch of the vendor for obtaining the $1.30 item, microcomputer 207 follows the selection switch interrupt routine (FIGS. 22A and 22B). After identifying the selection switch and determining the price of the selected item, microcomputer 207 computes the difference between the customer's credit and the price, which in this case is five cents. Since this difference is positive, microcomputer 207 checks the latest data received from microcomputer 201 to see if a nickel is available in the nickel tube for use as change. If so, microcomputer 201 is signalled to accept the escrowed coins and to return a nickel to the customer in change. Microcomputer 207 decrements the customer's credit by that amount and returns to its standby loop because the customer's credit at that point is zero.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Coin apparatus for use in a vendor and for handling coins deposited in the vendor and for making change, comprising:

a plurality of change tubes, one for each of a plurality of denominations of coins that may be deposited in the vendor, each of said tubes being adapted to hold a supply of coins of a respective denomination, and adapted to have coins drop into it for stocking it with coins;

each of said change tubes having associated with it means for sensing the stocking of the tube with coins up to a predetermined amount;

coin sorting means for sorting coins of said denominations and delivering to each change tube coins of the denomination for that tube;

means for holding coins in escrow for delivery either to a cash box or to a return system of the vendor;

an accept/return gate movable between a closed position for delivery of unacceptable items deposited in the vendor to the return system of the vendor and an open position for acceptance of a coin for delivery of the coin either to the coin sorting means or the escrow means, a coin sorting/escrow gate above the escrow means and below the accept/return gate movable between a closed position for delivery of accepted coins to the coin sorting means and an open position for delivery of an accepted coin to the escrow means, control means controlled by said sensing means for opening the accept/return gate with the coin-sorting/escrow gate closed for delivery of accepted coins of each denomination to the coin sorting means as long as the change tube for coins of that denomination needs coins to bring the supply therein up to the respective predetermined amount, and for opening the accept/return gate and the coin-sorting escrow gate for delivery of coins of each of said denominations to said escrow means when the respective change tube does not need coins;

means for actuating said escrow means to deliver any coins therein to said cash box upon operation of the vendor by a customer for a vend, and for actuating said escrow means to deliver any coins therein to said return system of the vendor upon operation by a customer of a coin return means of the vendor; and means operable on operation of said coin return means by a customer for delivering coins from the change tubes to said return system of the vendor in amount corresponding to that deposited by the customer in the vendor and delivered to the change tubes.

2. Coin apparatus as set forth in claim 1 wherein said means for delivering coins from the change tubes is operable to deliver coins in the same number and denomination as those deposited by the customer in the vendor and delivered to the change tubes.

3. Coin apparatus as set forth in claim 2 further comprising means operable upon operation of the vendor by a customer for a vend at one of a number of prices to deliver change as needed from the change tubes to the return system concomitantly with the delivery from the escrow means of any coins therein to the cash box.

4. Coin apparatus as set forth in claim 1 having means providing a passage for travel of an item deposited in the vendor to the accept/return gate, and wherein said control means includes means located along said passage means for detecting whether an item traveling along in said passage means is an acceptable coin and, if it is an acceptable coin, detecting its denomination, said control means being controlled by said detecting means with respect to coin denomination and by said sensing means with respect to the supply of coins in the change tubes.

5. Coin apparatus as set forth in claim 4 having a first gate-controlling coin passage sensor between said coin detecting means and the accept/return gate operable on passage of a coin thereby to effect operation of the gates, a second gate-controlling coin passage sensor for sensing passage of a coin off the coin-sorting/escrow gate operable following opening of the accept/return gate and closing of the coin-sorting/escrow gate for delivery of a coin to the coin-sorting means to deliver a signal for closing the accept/return gate, and a third gate-controlling coin passage sensor for sensing passage of a coin falling past the open coin-return/escrow gate operable following opening of the accept/return gate with the coin-return/escrow gate remaining open for delivery of a coin to the escrow means to deliver a signal for closing the accept/return gate.

6. Coin apparatus as set forth in claim 5 wherein the second coin passage sensor is operable on sensing passage of a coin to the coin-sorting means to deliver a signal for customer crediting and indicating that the coin entered the coin sorting means for delivery to the respective change tube, and the third coin passage sensor is operable on sensing passage of a coin to deliver a signal for customer crediting and indicating that the coin passed into the escrow means.

7. Coin apparatus as set forth in claim 1 wherein said escrow means comprises means for receiving coins and a closure for holding them in escrow either for passage to the cash box of the vendor or to the coin return system of the vendor, the closure being movable between a closed position for holding coins in escrow and an open position for release of coins from escrow, passaging below said closure and means in said passaging movable between a first position for delivery of coins released from escrow to the cash box and a second position for delivery of coins released from escrow to said coin return system, and means operable through a cycle for opening the closure to release coins and then reclosing it and controlling the coin delivery means for delivery of coins to the cash box, and alternately for opening the closure to release coins and then reclosing it and controlling the coin delivery means for delivery of coins to said return system.

8. Coin apparatus as set forth in claim 7 wherein the means operable through a cycle comprises a reversible electric motor operable through a cycle in one direction for opening the closure to release coins and then reclosing it and controlling the coin delivery means for delivery of coins to the cash box and through a cycle in the opposite direction for opening the closure to release coins and then reclosing it and controlling the coin delivery means for delivery of coins to said return system.

9. Coin apparatus for use in a vendor for handling acceptable coins and unacceptable items, including unacceptable coins, deposited in the coin slot of the vendor and for making change, said apparatus comprising:

a first chute inclined downwardly from one side of the apparatus toward the other, down which acceptable coins and unacceptable items received from the coin slot of the vendor may roll;

an accept/return gate adjacent the lower end of the first chute;

a second chute below the first chute extending from the accept/return gate and inclined downwardly toward said one side of the apparatus for delivery of unacceptable items to a return system of the vendor;

a coin-sorting/escrow gate below the first gate;

means below the coin-sorting/escrow gate for holding coins in escrow for delivery either to a cash box or to the return system of the vendor;

a third chute below the second chute extending from the coin-sorting/escrow gate and inclined downwardly toward said one side of the apparatus;

said third chute constituting a coin sorting chute and having coin-diameter-related drop-out openings along its length for drop-out of coins of different denominations;

each change tube having associated with it means for sensing the stocking of the tube with coins up to a predetermined amount;

means located along the first chute for detecting whether an item rolling down the first chute is an acceptable coin and, if it is an acceptable coin, detecting its denomination;

the accept/return gate being normally closed for delivery of unacceptable items to said second chute for return;

means responsive to detection of an acceptable coin by the detecting means to open the accept/return gate for acceptance of said coin;

means responsive to said detecting means detecting coins of the different acceptable denominations and to the sensing means sensing the amount of coins in the change tubes to open the coin-sorting/escrow gate for delivery of an accepted coin to the escrow means when the change tube for coins of that denomination does not need coins to bring the supply therein up to the respective predetermined amount, the coin-sorting/escrow gate being closed for delivery of the accepted coin via the third chute to the respective change tube when the latter needs coins to bring the supply therein up to the respective predetermined amount;

means for actuating said escrow means to deliver any coins therein to said cash box upon operation of the vendor by a customer for a vend, and for actuating said escrow means to deliver any coins therein to said return system of the vendor upon operation by a customer of a coin return means of the vendor; and means operable on operation of said coin return means by a customer for delivering coins from the change tubes to said return system of the vendor in amount corresponding to that deposited by the customer in the vendor and delivered to the change tubes.

10. Coin apparatus as set forth in claim 9 having a first gate-controlling coin passage sensor between said coin detecting means and the accept/return gate operable on passage of a coin thereby to effect operation of the gates, a second gate-controlling coin passage sensor for sensing passage of a coin off the coin-sorting/escrow gate operable following opening of the accept/return gate and closing of the coin-sorting/escrow gate for delivery of a coin to the coin-sorting means to deliver a signal for closing the accept/return gate, and a third gate-controlling coin passage sensor for sensing passage of a coin falling past the open coin-return/escrow gate operable following opening of the accept/return gate with the coin-return/escrow gate remaining open for delivery of a coin to the escrow means to deliver a signal for closing the accept/return gate.

11. Coin apparatus as set forth in claim 10 wherein the second coin passage sensor is operable on sensing passage of a coin to the coin-sorting means to deliver a signal for customer crediting and indicating that the coin entered the coin sorting means for delivery to the respective change tube, and the third coin passage sensor is operable on sensing passage of a coin to deliver a signal for customer crediting and indicating that the coin passed into the escrow means.

12. Coin apparatus as set forth in claim 9 wherein said escrow means comprises means for receiving coins and a closure for holding them in escrow either for passage to the cash box of the vendor or to the coin return system of the vendor, the closure being movable between a closed position for holding coins in escrow and an open position for release of coins from escrow, passaging below said closure and means in said passaging movable between a first position for delivery of coins released from escrow to the cash box and a second position for delivery of coins released from escrow to said coin return system, and means operable through a cycle for opening the closure to release coins and then reclosing it and controlling the coin delivery means for delivery of coins to the cash box, and alternately for opening the closure to release coins and then reclosing it and controlling the coin delivery means for delivery of coins to said return system.

13. Coin apparatus as set forth in claim 12 wherein the means operable through a cycle comprises a reversible electric motor operable through a cycle in one direction for opening the closure to release coins and then reclosing it and controlling the coin delivery means for delivery of coins to the cash box and through a cycle in the opposite direction for opening the closure to release escrow means to deliver any coins therein to said return system of the vendor upon operation by a customer of a coin return means of the vendor.

14. Coin apparatus for use in a vendor having an escrow system comprising means for receiving coins and a closure for holding them in escrow either for passage to a cash box of the vendor or to a coin return system of the vendor, the closure being movable between a closed position for holding coins in escrow and an open position for release of coins from escrow, passaging below said door and means in said passaging movable between a first position for delivery of coins released from escrow to the cash box and a second position for delivery of coins released from escrow to said coin return system, and means operable through a cycle for opening the closure to release coins and then reclosing it and controlling the coin delivery means for delivery of coins to the cash box, and alternately for opening the closure to release coins and then reclosing it and controlling the coin delivery means for delivery of coins to said return system, said closure comprising a gate pivoted for swinging movement between said closed and open positions and said means movable between a first and a second position comprising a flap pivoted for swinging movement between said first and second positions, and said means operable through a cycle comprises a cam having a first formation for operating the gate and a second formation for operating the flap, said cam being rotatable through a revolution in one direction for opening the gate to release coins and then reclosing it and controlling the flap to dwell in its first position for the delivery of the released coins to said cash, and rotatable through a revolution in the opposite direction for opening the gate to release coins and then reclosing it and controlling the flap to swing to its second position for delivery of coins to said return system.

15. Coin apparatus as set forth in claim 14 wherein said means operable through a cycle further comprising a reversible electric motor for driving the cam through a single revolution cycle in one direction and alternately through a single revolution cycle in the opposite direction.

* * * * *